US009248695B2

(12) United States Patent
Radvanyi

(10) Patent No.: US 9,248,695 B2
(45) Date of Patent: Feb. 2, 2016

(54) MOSAIC PIECE

(75) Inventor: Gabor Radvanyi, Budapest (HU)

(73) Assignee: DOOP MUSZAKI ES FORMAFEJLESZTO KFT., Budapest (HU)

( * ) Notice: Subject to any disclaimer, the term of this patent is extended or adjusted under 35 U.S.C. 154(b) by 0 days.

(21) Appl. No.: 14/125,487

(22) PCT Filed: Jun. 13, 2012

(86) PCT No.: PCT/IB2012/052986

§ 371 (c)(1), (2), (4) Date: Dec. 11, 2013

(87) PCT Pub. No.: WO2012/172494

PCT Pub. Date: Dec. 20, 2012

(65) Prior Publication Data

US 2014/0124472 A1 May 8, 2014

Related U.S. Application Data

(60) Provisional application No. 61/496,614, filed on Jun. 14, 2011.

(51) Int. Cl.

| | |
|---|---|
| ***B65D 21/02*** | (2006.01) |
| ***B44C 3/12*** | (2006.01) |
| ***A63F 9/00*** | (2006.01) |
| ***A63F 9/06*** | (2006.01) |
| ***A63F 9/10*** | (2006.01) |

(Continued)

(52) U.S. Cl.

CPC ..... *B44C 3/123* (2013.01); *A63F 9/001* (2013.01); *A63F 9/0669* (2013.01); *A63F 9/10* (2013.01); *A63F 9/12* (2013.01); *B44C 3/12* (2013.01); *B65D 41/04* (2013.01); *A63F 2009/0015* (2013.01); *A63F 2009/067* (2013.01); *Y10T 428/219* (2015.01)

(58) Field of Classification Search

CPC . A63H 33/082; A63H 33/062; A63H 33/084; A63H 33/33086; B65D 21/0204; B65D 21/0202; B65D 41/04; A63F 9/001; A63F 9/0669; A63F 9/10; A63F 9/12; A63F 2009/0015; A63F 2009/067; B44C 3/12

USPC ..... 220/23.4, 212; 215/228

See application file for complete search history.

(56) References Cited

U.S. PATENT DOCUMENTS 2,406,759 A * 9/1946 Glukes ..... 446/127
3,456,413 A * 7/1969 Fischer ..... 52/591.1

(Continued)

FOREIGN PATENT DOCUMENTS

CN 1148025 A 4/1997
EP 0 677 455 A1 10/1995

(Continued)

OTHER PUBLICATIONS

International Search Report for International Application No. PCT/IB2012/052986; 2 pages; mailed Oct. 15, 2012.

*Primary Examiner* — Mickey Yu
*Assistant Examiner* — Niki Eloshway
(74) *Attorney, Agent, or Firm* — Vorys, Sater, Seymour and Pease LLP

(57) ABSTRACT

Provided is a mosaic piece having a body contour inscribed within a circle, and being formed with at least one projection having a projection contour.

20 Claims, 22 Drawing Sheets

(51) Int. Cl.

| | |
|---|---|
| ***A63F 9/12*** | (2006.01) |
| ***B65D 41/04*** | (2006.01) |
| *B65D 21/028* | (2006.01) |

(56) References Cited

U.S. PATENT DOCUMENTS

| | | | | |
|---|---|---|---|---|
| 3,583,091 | A * | 6/1971 | Brockway | 446/121 |
| 5,183,278 | A * | 2/1993 | Wade, Jr. | 280/47.35 |
| 5,638,974 | A * | 6/1997 | Mann | 220/23.4 |
| 5,653,621 | A * | 8/1997 | Yao | 446/127 |
| 6,296,541 | B1 * | 10/2001 | Bezalel et al. | 446/105 |
| 6,702,642 | B1 * | 3/2004 | Parein | 446/105 |
| 8,695,820 | B2 * | 4/2014 | Rabie | 215/252 |
| 2005/0106989 | A1 * | 5/2005 | Rincover | 446/85 |
| 2010/0308043 | A1 * | 12/2010 | Wimmer | 220/23.4 |
| 2013/0178130 | A1 * | 7/2013 | Balint | 446/120 |

FOREIGN PATENT DOCUMENTS

| | | | |
|---|---|---|---|
| EP | 000999339-0001 | | 9/2008 |
| FR | 1 273 609 | A | 10/1961 |
| FR | 2 608 066 | A1 | 6/1988 |
| WO | 99/48582 | A1 | 9/1999 |
| WO | 99/67151 | A1 | 12/1999 |
| WO | 2010/086774 | A2 | 8/2010 |

* cited by examiner

MOSAIC PIECE

FIELD OF THE INVENTION

This invention relates to bottle caps, in particular, bottle caps which may be articulated to one another

BACKGROUND OF THE INVENTION

It is known to make divisions of space by geometric shapes, in particular, division of such a space to be covered with identical shapes. Such a division is usually referred to as a mosaic, tiling etc. Examples of such mosaic/tiling can be covering a defined space with hexagons, triangles and even more complex shapes.

In addition, it is known to make mosaic piece for the purpose of games, especially for children (e.g. jigsaw puzzles), in which a certain image or a shape is to be formed by adjoining specific mosaic pieces to one another.

SUMMARY OF THE INVENTION

According to the subject matter of the present application, there is provided a uniquely designed mosaic piece which is configured to be articulated to similar mosaic pieces. Specifically, the mosaic piece is configured for interlocking with similar mosaic pieces so that two such mosaic pieces can be securely held together without the aid of additional mosaic pieces or of an adhering mechanism.

According to a specific aspect of the subject matter of the present application, there is provided a mosaic piece having a body contour inscribed within a circle, and being formed with at least one projection having a projection contour, so that:

said body contour and said projection contour coincide at points $P_1$ and $P_2$;

said inner circle further contains a point $P_3$ located outside said projection contour so that the angular distance of $P_3$ from $P_1$ is equal to the angular distance of $P_2$ from $P_1$ with respect to the center of the inner circle;

said projection contour further contains a point Pa so that the entire projection contour is located on one side of a reference border line B.L. extended between point $P_3$ and a point Pa;

said mosaic piece being formed with a locking recess having a locking recess contour defined between points $P_3$-$P_1$-Pa;

said projection contour further comprising a point P' between points Pa and $P_1$;

said projection is formed with an engagement portion having an engagement contour defined between points P'-Pa-$P_2$ and a line L extending between points P' and $P_2$;

wherein said engagement portion is of corresponding shape and size to be fully contained within said locking recess.

The mosaic piece can be configured for attachment to other mosaic pieces, so that at least a portion of the projection of the mosaic piece is configured to be received within a locking recess of a second identical mosaic piece. In particular, when a projection of the mosaic piece is received within a locking recess of a second, identical mosaic piece, the body engagement contour of the mosaic piece and the projection engagement contour of the second mosaic piece can form together a contour at least partially corresponding to the contour defined between points $P_1$ and $P_2$ of the mosaic piece. Under this arrangement, a third mosaic piece is configured to fit within a remaining space defined by the contour between two neighboring mosaic pieces.

According to a specific example, said mosaic piece can be formed with a projection unit consisting of two symmetric projections which are mirror images of one another with respect to a line extending between point $P_2$ and the center of the inner circle. Specifically, the point $P_2$ can be a mutual point for the projection contours of the two symmetric projections.

Under a specific example of the mosaic piece, it can comprise at least two projection units, said projection units being arranged symmetrically along the mosaic piece with respect a line extending between point $P_3$ and the center of the inner circle.

In particular:

said projection unit has a unit contour defined between the respective points $P_1$ of two projections of the projection unit and containing therein point $P_2$; and said mosaic piece has a body portion contour defined between the respective points Pa of two neighboring projection units and containing therein point $P_3$.

The arrangement can be such that said body portion contour corresponds in shape and size to said unit contour.

According to a particular example, said mosaic piece can be formed with three projection units. The projection units can be equally spaced about the center of the inner circle, i.e. with a 120° angle therebetween.

In addition, said projection can be made of flexible material allowing to change the distance between points Pa of adjacent protection units thereby providing snap fitting between two identical mosaic pieces. The material of the projection and its shape can be such that the friction between two identical mosaic pieces, when attached to one another as suggested above, is sufficient for preventing movement thereof with respect to one another along a central axis of the inner circle.

Furthermore, the bottle caps can be made of a material which, once the mosaic pieces are constructed together, may be ironed to form a single unit.

Under a specific arrangement, the ratio between the diameter of the inner circle d and the diameter D of a circle inscribing the entire mosaic piece including the at least one projection is d/D can be about 0.9.

According to another aspect of the subject matter of the present application, there is provided a method for constructing the 2D shape of the above mosaic piece, said method including the following steps:

providing three major shapes, each shape being symmetric about at least three axes, equally spaced at 120° and coinciding at O;

each two neighboring major shapes having a contact point at $P_2$;

Providing one median line for each two neighboring major shapes passing through the respective point $P_2$ and point O of the remaining major shape, intersecting its contour at a point $P_1$, three such tangency lines intersecting each other at a point $P_0$ located at an area A between the major shapes and not occupied thereby;

Providing three minor shapes within area A which are equally spaced at 120° about point $P_0$, each minor shape having at least a contact point with one of the major shapes at its respective point $P_1$, and another point P located in area A;

wherein for each major shape, a projection can be defined having a contour extending through points $P_2$, $P_1$ of the neighboring major shape, P and $P_1$ of the same major shape.

According to the above method, the major shapes can serve as the basis for defining the shape of the body of the mosaic piece while the minor shapes can serve as the basis for defining the projection of the mosaic piece.

Under a particular example of the above method, each of the major shapes has a hexagonal symmetry, about six axes, equally spaced at 120° and coinciding at O, such as hexagons and even circles. It should be noted that for each variation of the major shape serving as the basis for mosaic piece, different contact points $P_2$ can be chosen. For example, if the major shapes are circles, the points $P_2$ can be tangency points between the circles, whereas if the major shapes are hexagons, the points $P_2$ can be alternating apexes of the hexagon.

The contour of the minor shapes can be defined by curved lines only, by straight lines only or by a combination of the two. The minor shapes can be either closed-contour shapes of opened-contour shapes. In addition, the minor shapes can have a point of coincidence at $P_0$, and can be designed so as not to intersect one another.

It should also be understood that said 2D shape of the mosaic piece can constitute the base for a 3D construction of a mosaic piece. In particular, said major shapes can be of a 3D tetrahedral configuration, in which each face of the 3D mosaic piece is of a triangular or hexagonal symmetry.

The mosaic piece of the present application can be formed with an inner cavity, configured for receiving therein an article of predetermined size and shape. According to one example, said inner cavity can be threaded, and can be shaped and sized so as to be configured for use as a bottle cap. Alternatively, according to another example, said cavity can be shaped and sized to hold therein an article of cylindrical shape such as a bottle, a can etc.

It should be noted that forming a bottle cap with the unique shape design of the above described mosaic piece provides for several advantages, some of which are as follows:

- since the shape of the bottle cap is no longer circular, it can provide a more comfortable gripping of the bottle cap and facilitate easier opening of a bottle fitted with such a cap;
- an opener can be provided having a cavity which is sized and shaped to that of the bottle cap so that inserting the bottle cap into the cavity and rotating the bottle can provide easier opening, especially for children and elderly people;
- the bottle caps can be articulated to one another (in 2D or 3D) to form complex structures which can be used for practical purposes, e.g. a coaster, a tray, flooring etc. For example, a plurality of such bottle caps can for the floor of a tent pitched on sand in poor countries such as Africa etc.;

Furthermore, different bottle caps can have thereon a predetermined color, pattern or image, so that combining a plurality of bottle caps to one another allows forming a bigger picture. This can also be used for marketing purposes in which people will prefer buying more and more bottle in order to obtain the mosaic piece constituted by the bottle cap in order to complete a jigsaw puzzle and/or bigger picture.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1A:
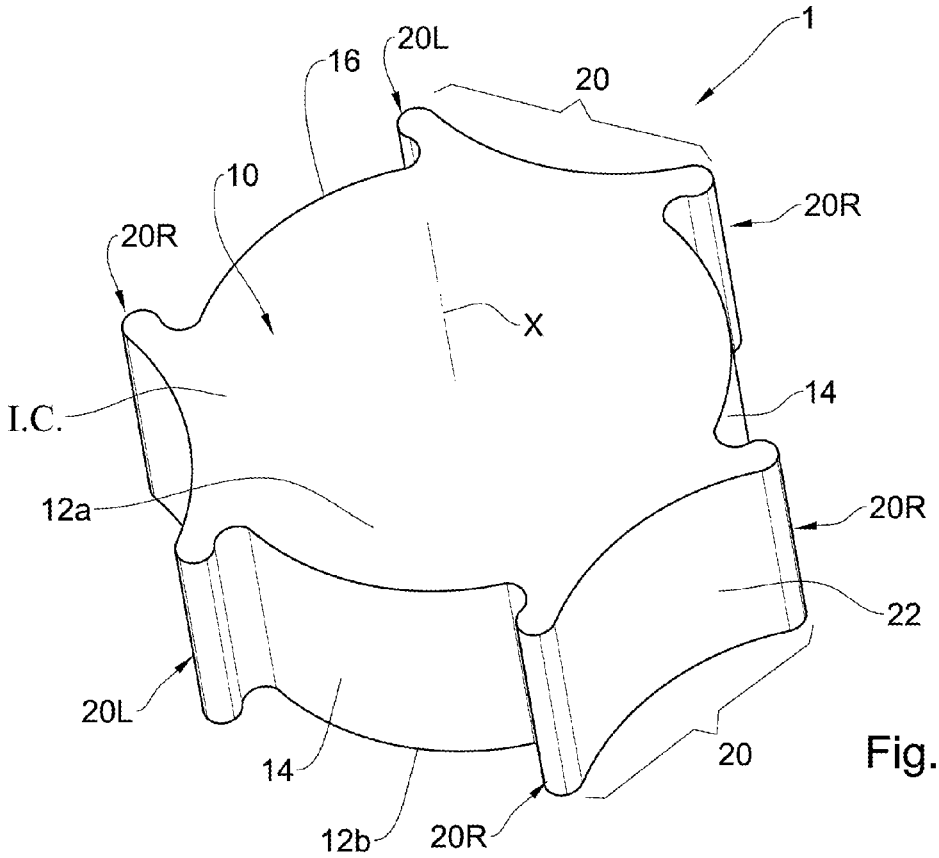
FIG. 1A is a schematic isometric view of a mosaic piece according to the subject matter of the present application.
Figure 1B:
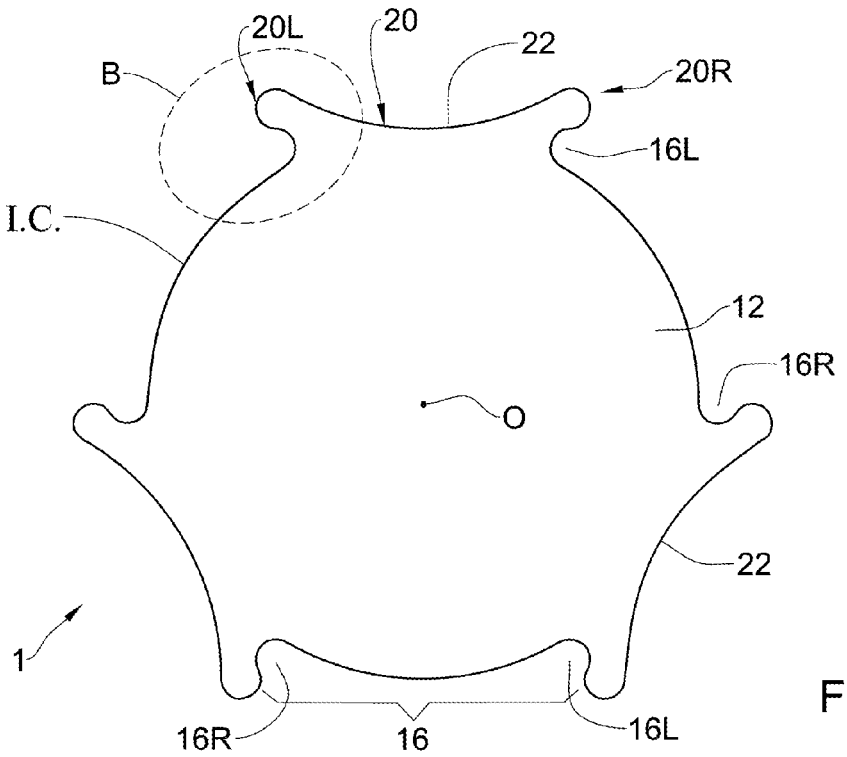
FIG. 1B is a schematic top view of a mosaic piece according to the subject matter of the present application.

With reference to FIGS. 1A and 1B, a mosaic piece generally designated as 1 having a generally circular body 10 with a central axis X and three projection units 20 equally spaced about the body 10.

The body 10 is inscribed within a circle IC the center of which lies at O (the axis X passing through O). Each of the projection units 20 lies outside the inscribing circle IC, and has a right projection portion 20R and a left projection portion 20L.

It is noted that the mosaic piece 1 has an extension along the axis X, so that the body 10 has a top face 12A and bottom face 12B with side walls 14 extending therebetween. In particular, the body 10 has three such side walls 14 each being defined between two neighboring projection units 20. Similarly, each projection unit is also formed with a side wall 22 extending between the top face 12A and the bottom face 12B.

The arrangement is such, that between each two neighboring projection units 20, a recess 16 is formed having a right locking portion 16R and a left locking portion 16L. It should be noted that the terminology 'left' and 'right' is defined with respect to the center O of the inscribing circle IC, whereby the left locking portion 16L is immediately adjacent to the right projection portion 20R and the right locking portion 16R is immediately adjacent the left projection portion 20L.

Each projection unit has a projection unit 20 contour, and each recess 16 has a recess contour, the term 'contour' referring to the closest delimiting curve which forms the boundary of the projection/recess. For example, while the actual curve forming the shape of the projection unit 20 can be undulating, the contour will be considered to be the delimiting curve of forming the boundary for the undulating curve (see FIG. 14).

Figure 1C:
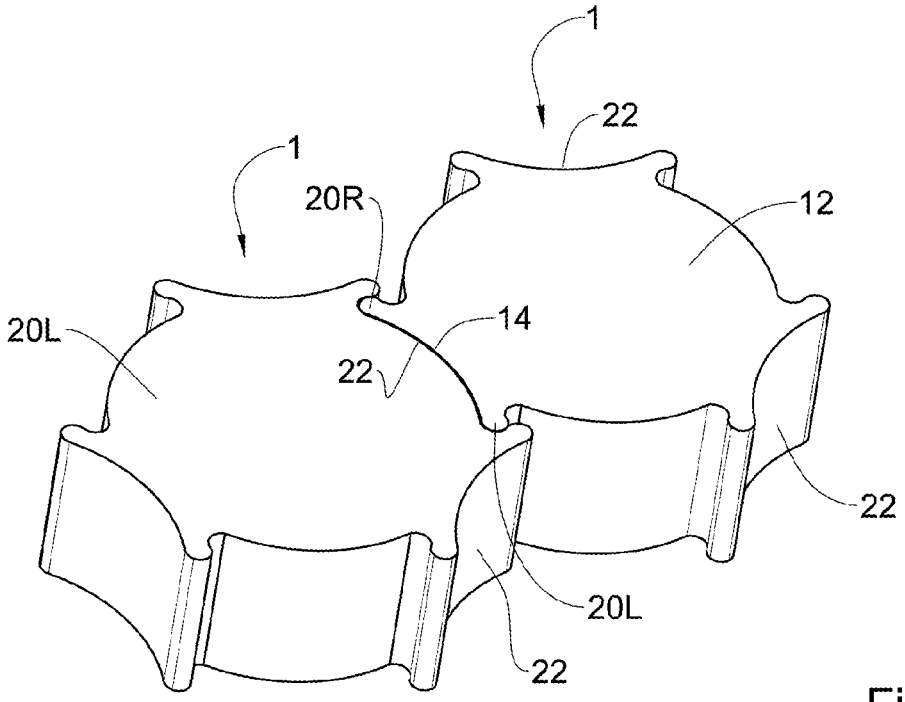
FIG. 1C is a schematic isometric view of two mosaic pieces of FIG. 1A, when attached to one another.
Figure 1D:
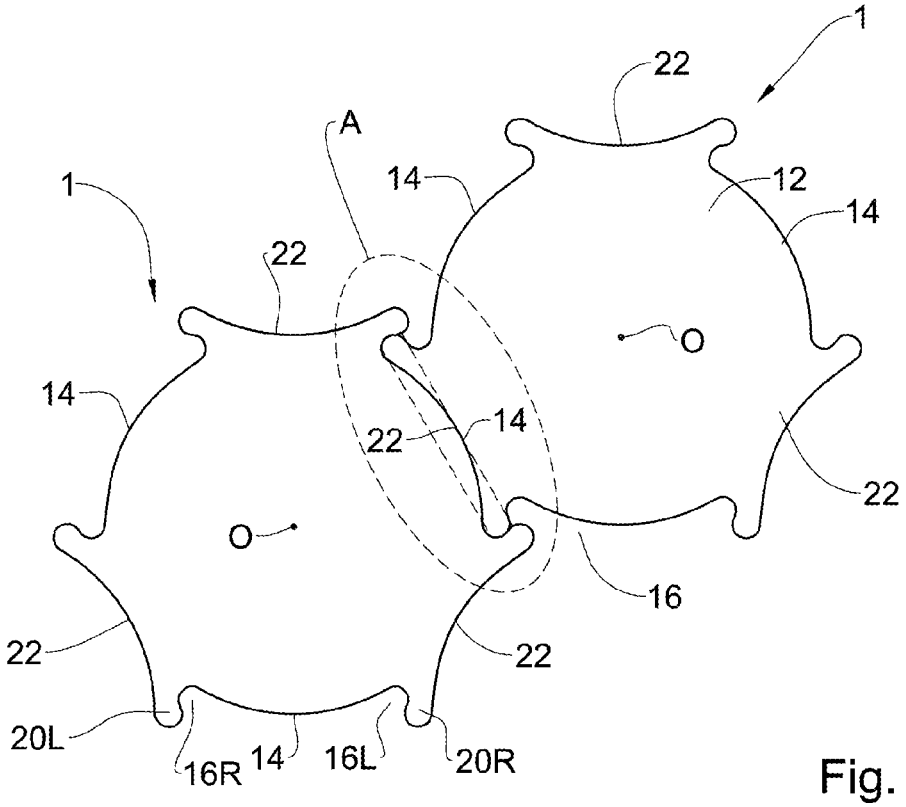
FIG. 1D is a schematic top view of the mosaic pieces shown in FIG. 1C.
Figure 1E:
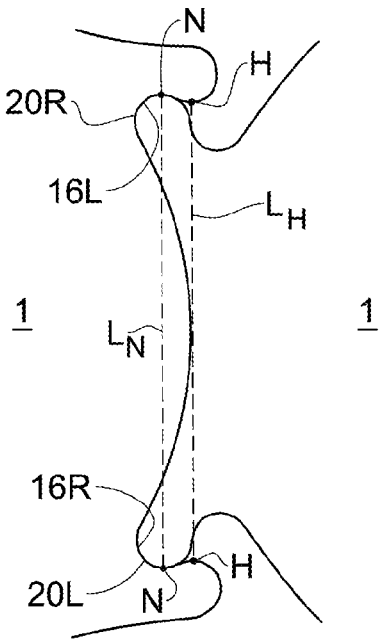
FIG. 1E is a schematic enlarged view of detail A shown in FIG. 1D.
Figure 2:
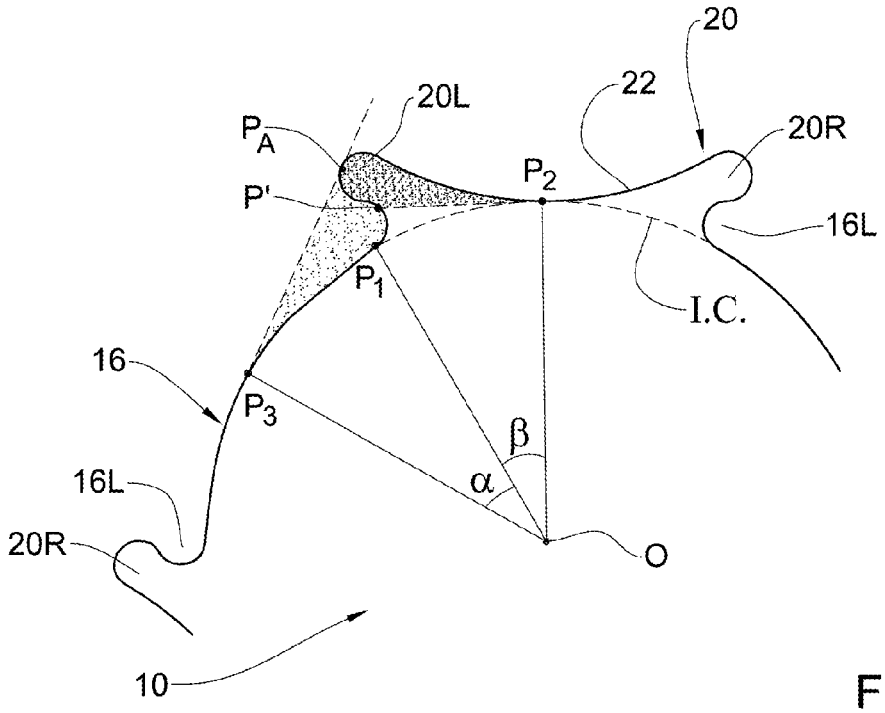
FIG. 2 is a schematic enlarged view of detail B shown in FIG. 1B.
Figure 3A:
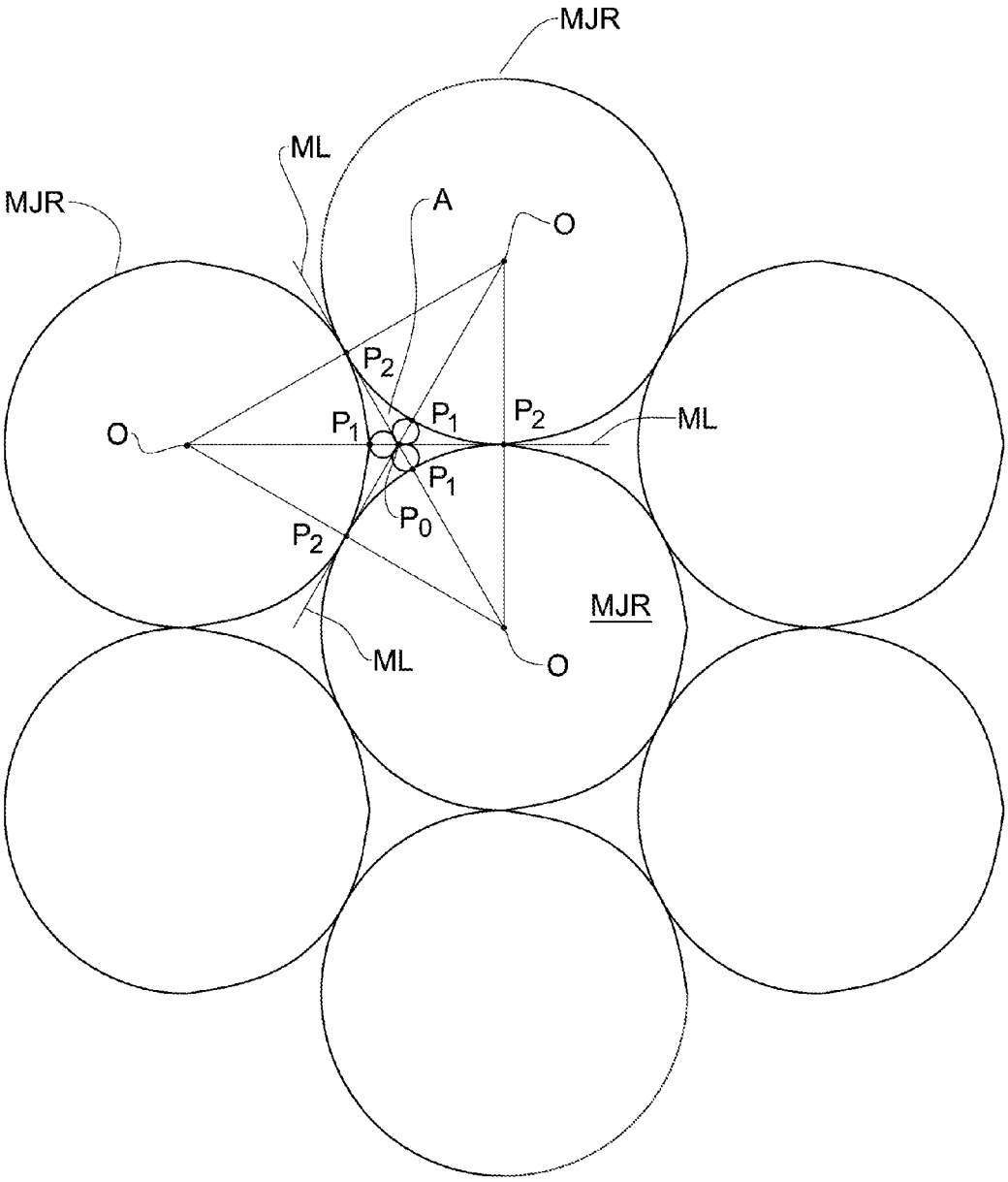
FIGS. 3A to 3C are schematic planar views of steps of constructing the unique shape of the mosaic piece shown in FIGS. 1A and 1B.
Figure 3B:
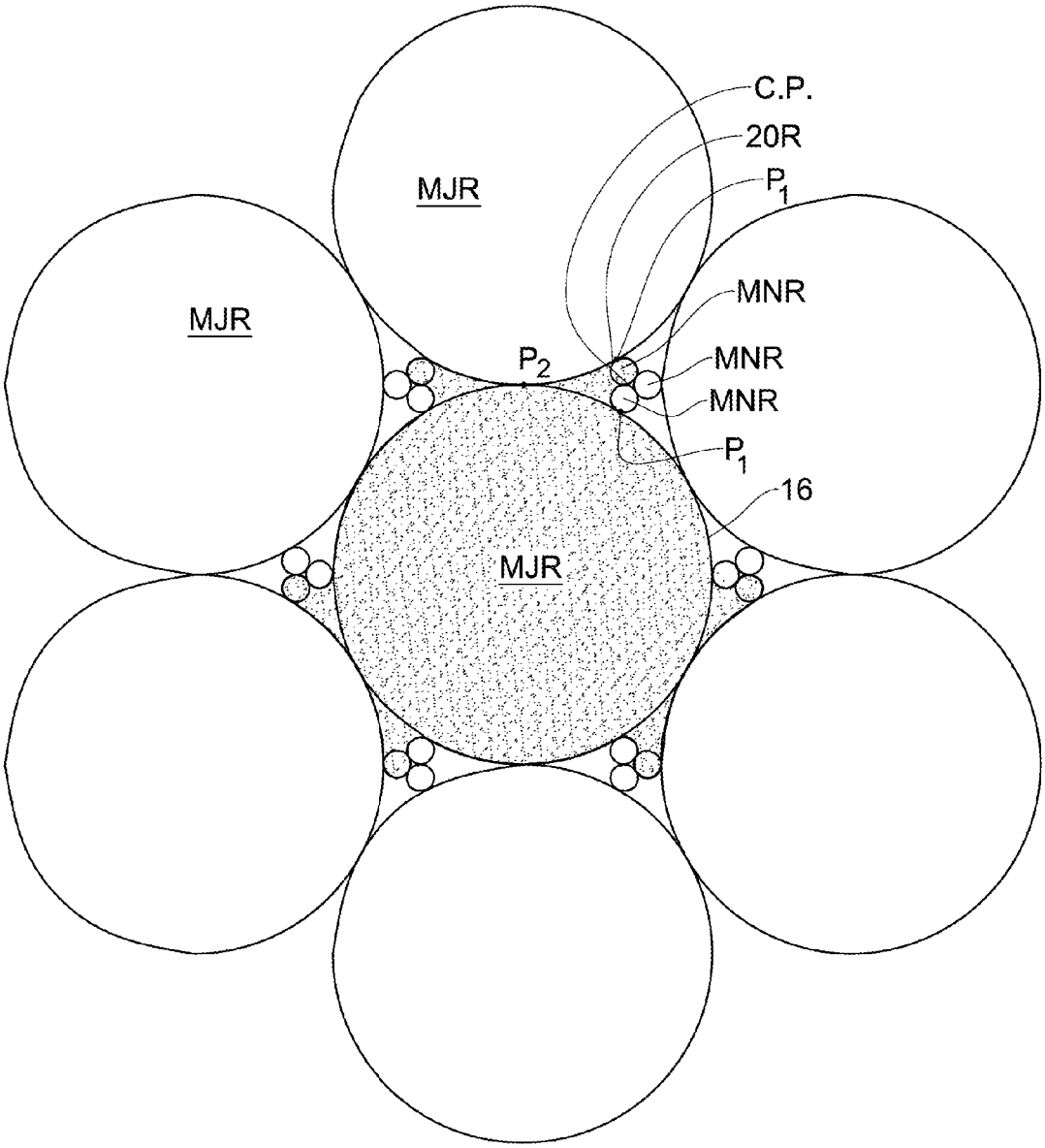
Figure 3C:
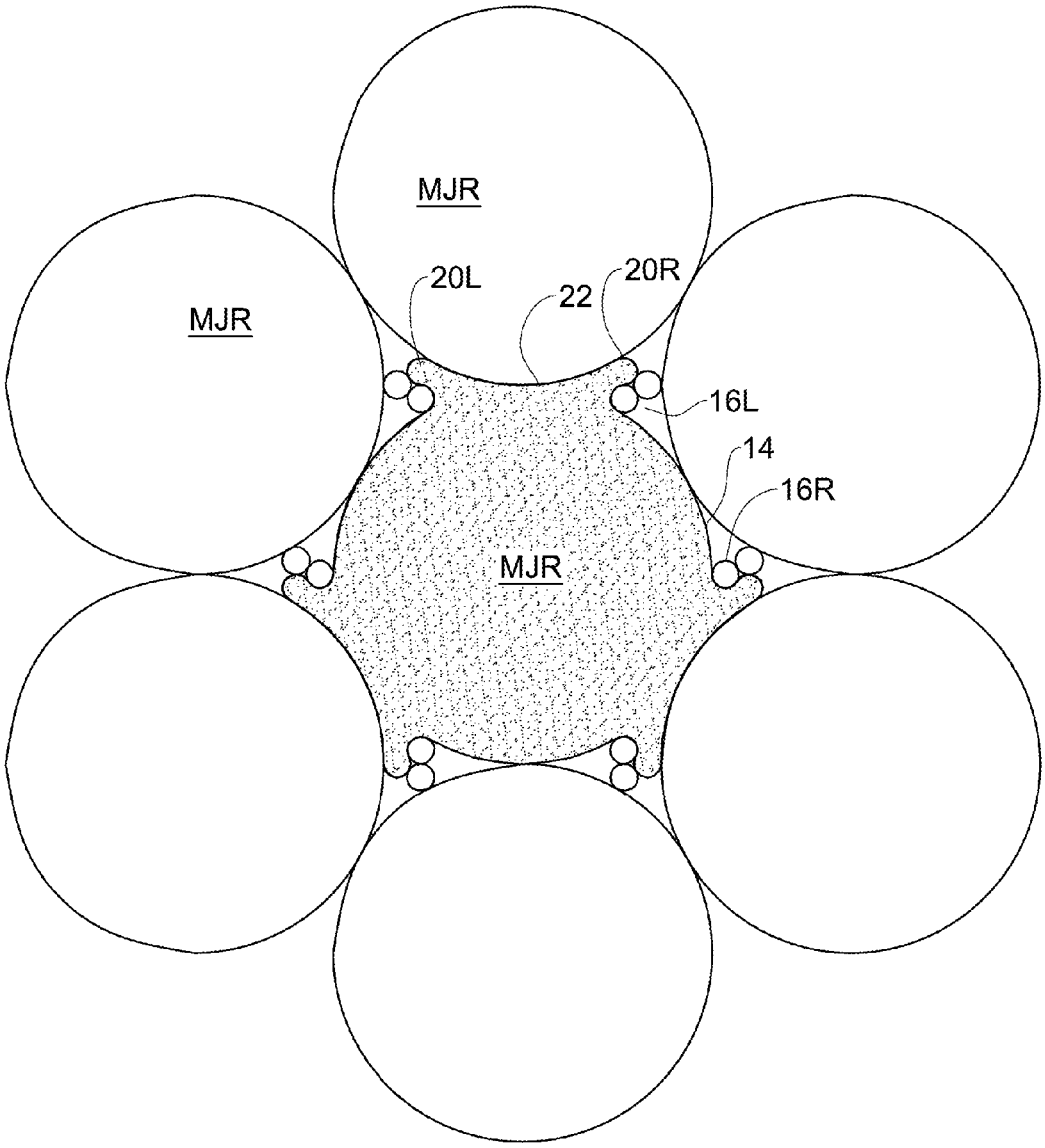

With specific reference being made to FIGS. 1C to 1E, it is observed that due to the unique design of the mosaic piece (the construction of which will be further elaborated with respect to FIGS. 2 to 3D), the shape and size of the recess 16 closely matches the shape of the projection unit 20. More particularly, the shape and size of the contour of the recess 16 closely matches the shape and size of the contour of the 30 projection unit 20. The term 'closely matches' can refer heretofore to a design where, in engagement, the majority of the contour of the projection unit 20 and the contour of the recess 16 are in engagement with one another. Alternatively, this term can refer to an arrangement in which the curve delimiting the contour of the projection unit 20 and the curve delimiting the recess 16 are in engagement.

It is appreciated that even if each of the actual curves forming the shape of the recess 16 and the projection unit 20 are of an undulating configuration, the contours thereof can still match. For example, the actual contact between two mosaic pieces can take place at only several points along the curve, but the contours of the recess 16 and projection unit 20 match each other nonetheless.

Thus, two similar mosaic pieces 10 can be articulated to and engage one another by inserting the projection unit 20 of one mosaic piece 1 into the recess 16 of the other mosaic unit 1. In the engaged position as shown in the above figures, the right projection portion 20R is received within the left locking recess 16L of the adjacent mosaic portion and the left projection portion 20L of one mosaic piece is received within the right locking recess 16R of the adjacent mosaic piece.

It is noted that due to the unique design of the mosaic pieces, in the engaged position, the mosaic pieces 1 are interlocked with one another. In particular, it is observed that the greatest width of the projection unit 20 measured between points N (measured along a line perpendicular to a symmetry line dividing the projection unit 20 into a right and a left portion 20R, 20L) and denoted by line $L_N$ is slightly greater than the corresponding width measured between two neighboring projection units 20 of the other mosaic piece 1 between points M, denoted by line $L_M$.

Figure 1F:
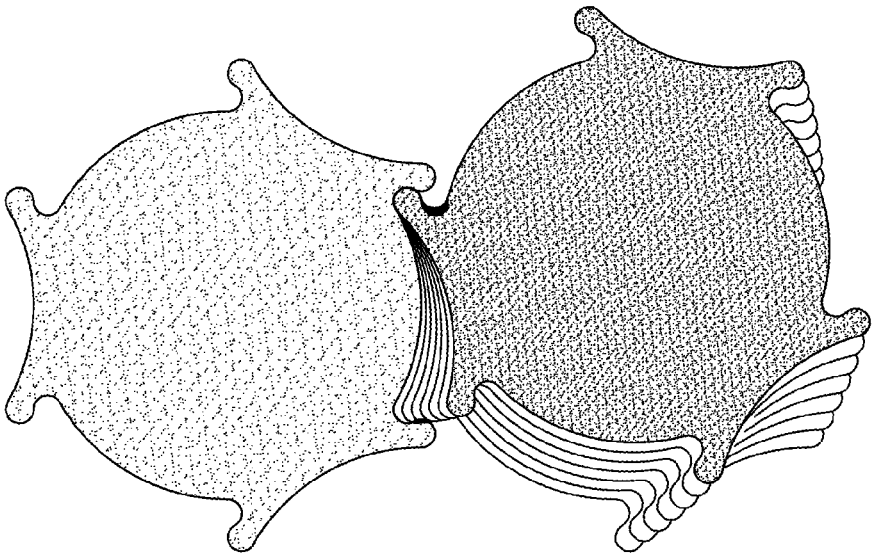
FIG. 1F is a schematic top view demonstrating the dynamic articulation of two mosaic pieces to one another.

In this interlocked position, the mosaic pieces 1 cannot perform radial movement away from one another, i.e. a movement which increases the distance between the respective centers O thereof. However, it is also noted that if at least one of the mosaic pieces is formed of at least partially flexible material, the unique design yields a snap-fit arrangement, as shown in FIG. 1F. It should further be noted that in the interlocked position, the mosaic pieces 1 are still free to perform axial displacement along the parallel axis X with respect to one another.

Figure 1G:
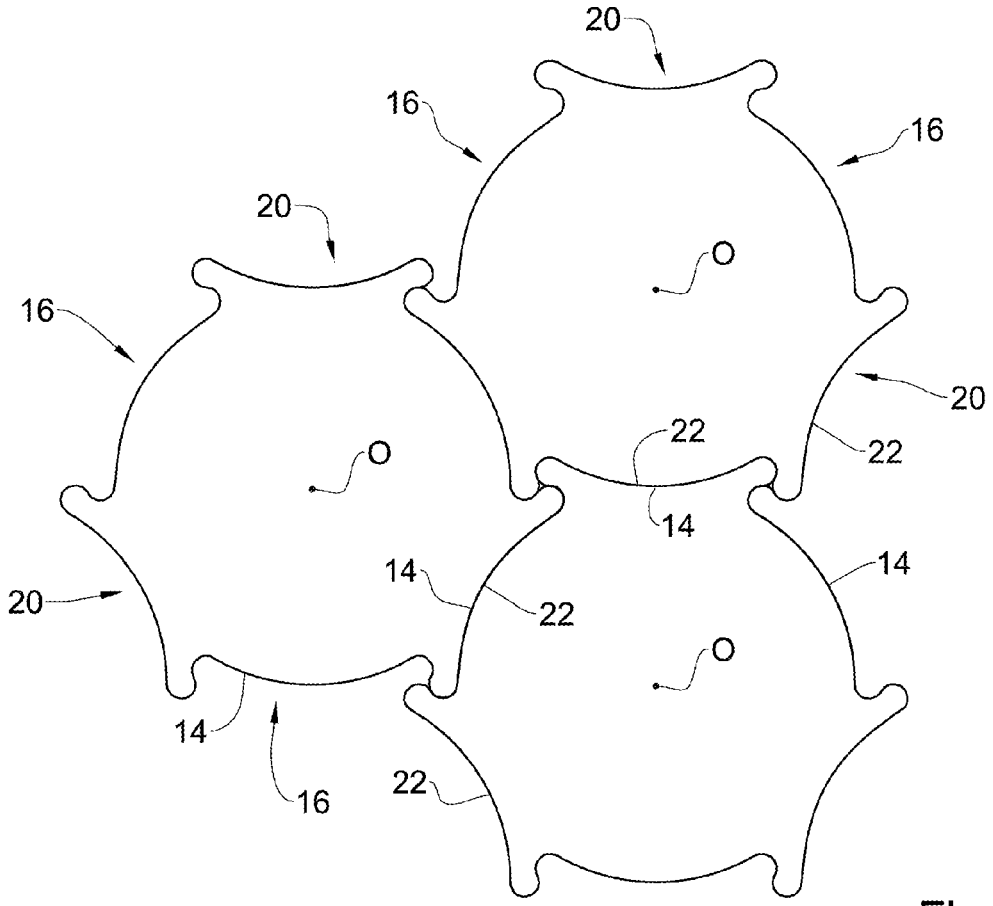
FIG. 1G is a schematic top view of three mosaic pieces of FIG. 1A, when articulated to one another.

With particular reference being made to FIG. 1G, it is observed that three mosaic pieces 1 may be articulated to one another in a similar manner. It is noted, that when two such mosaic pieces 1 are articulated to one another, the contour of the side walls 14 and of the recess walls 22 form the a shape which corresponds in shape and size to that of the third identical mosaic piece 1.

Turning now to FIG. 2, a geometric definition of the mosaic piece 1 will now be provided in detail. It is observed that the mosaic piece has a body 10 with a center at O (this is the point through which axis X passes), which is the center of the inscribing circle IC. The contour of the left projection portion 20L of the projection unit 20 lies outside the inscribing circle and is in the form of a curve extending between the points P1 and P2 which coincide with the contour of the inner circle IC.

Further, a point P3 can be defined which is located on the inner circle IC and having the same angular distance from P1 as P2 (angle $\alpha$ is equal to the angle $\beta$), and a straight border line BL can be extended between point P3 and a point $P_A$ on the contour of the left projection portion 20L, such that all points on the contour of the left projection portion 20L are located on one side of the borderline BL. Thus, a recess portion is defined (hatched) the contour of which extends through points P3, P1 and $P_A$ being partially formed by a portion of the inner circle, a portion of the contour of the projection portion 20L and a portion of the borderline BL.

Similarly, a point P can be chosen along the contour of the left projection portion 20L, located between points $P_1$ and $P_A$, and a straight line can be extended between these two points to define a projection portion (hatched).

The arrangement is such that the projection portion is fully contained, in its shape and size, within the recess portion of the recess 16. It should be noted that the term 'contained' is used herein to define that not only is the area (specific value, e.g. 2 square cm) is smaller than the area of the recess portion, but rather that the shape and size are such that can be taken, as is, and fitted into the recess portion being fully contained therein.

In particular, it is observed that when the part of the left projection portion 20L is received within the portion of the recess 16 the point P2 coincides with the point P3 of the other mosaic unit, and the line P2 to P coincides with the line BL.

Particular reference is now made to FIGS. 3A to 3D, showing the geometric construction used to design the mosaic piece shown in FIGS. 1A to 2:

Step A: A major shape MJR is chosen having a hexagonal symmetry. In this particular example the major shape is a circle having a center at O, and it should be understood that circle has an n-symmetry which also covers hexagonal symmetry;

Step B: Three such major shapes MJR are used and disposed along a planar surface such that each two adjacent major shapes MJR have at least one contact point at P2. In this particular example, the point P2 is defined as the tangency point between each two circles, however, it will be evident from further examples of various mosaic pieces that the point P2 is not necessarily the tangency point and is chosen according to the major shape MJR used to construct the mosaic piece. It is noted that the three major shapes MJR defined therebetween an area A which has a center point $P_0$, defined as the intersection point between the lines extending from the centers O of each major shape MJR and the point P2 of the other two major shapes MJR;

Step C: Three minor shapes MNR are chosen, and are disposed within the area A. In this particular example, circles are used as minor shapes MNR as well. However it will be evident from further examples of mosaic pieces that this is not necessarily the case. The minor shapes MNR are disposed within the area A such that the contour of each minor shape MNR has at least one contact point P1 with its respective major shape MJR and at least one contact point with the contour of each of the other two minor shapes MNR;

Step D: The contour of a left portion or right projection portion may now be defined in the following manner: the contour curve of such a projection portion will begin from point P1 following the contour of the minor shape MNR until its contact point with its adjacent minor shape MNR, then follow the contour of this adjacent minor shape MNR until its respective contact point P1 with the its major shape MJR and then follow the contour of that major shape MJR to point P2 thereby completing the contour. It is noted that such a contour always encompasses at least one minor shape MNR which does not share a common contact point with the major shape MJR to which this projection pertains.

It is further observed that for each major shape, a right projection portion 20R and a left projection portion 20L may be symmetrically defined as previously explained, constituting together the projection portion 20. The hexagonal symmetry of each major shape gives rise to forming the unique recess 16 formed between each two neighboring projection units 20. However, it should be noted that other examples of mosaic pieces will also be discussed in which such hexagonal symmetry is not required, and in which the locking recess has a slightly different configuration.

Figure 4:
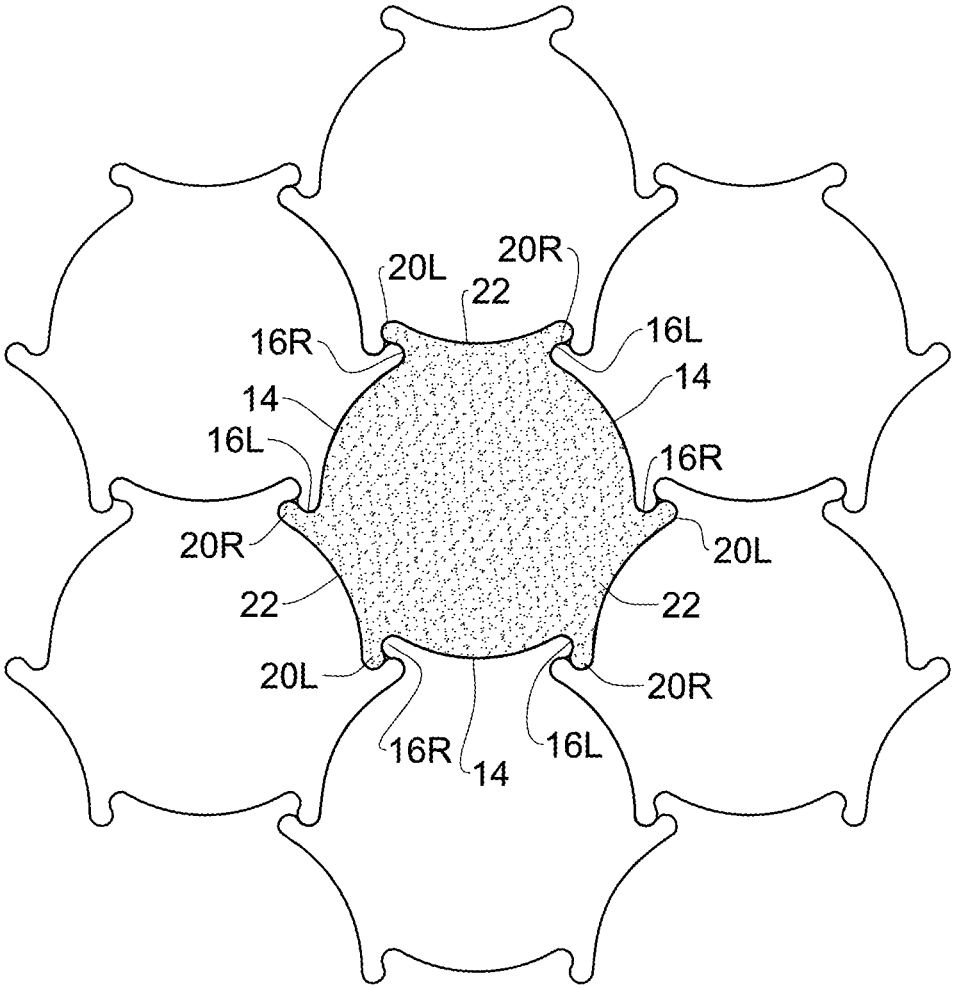
FIG. 4 is a schematic top view of a plane covered with a plurality of mosaic pieces shown in FIG. 1A and 1B.
Figures 5A, 5B, 5C, 5D, 5E, 5F:
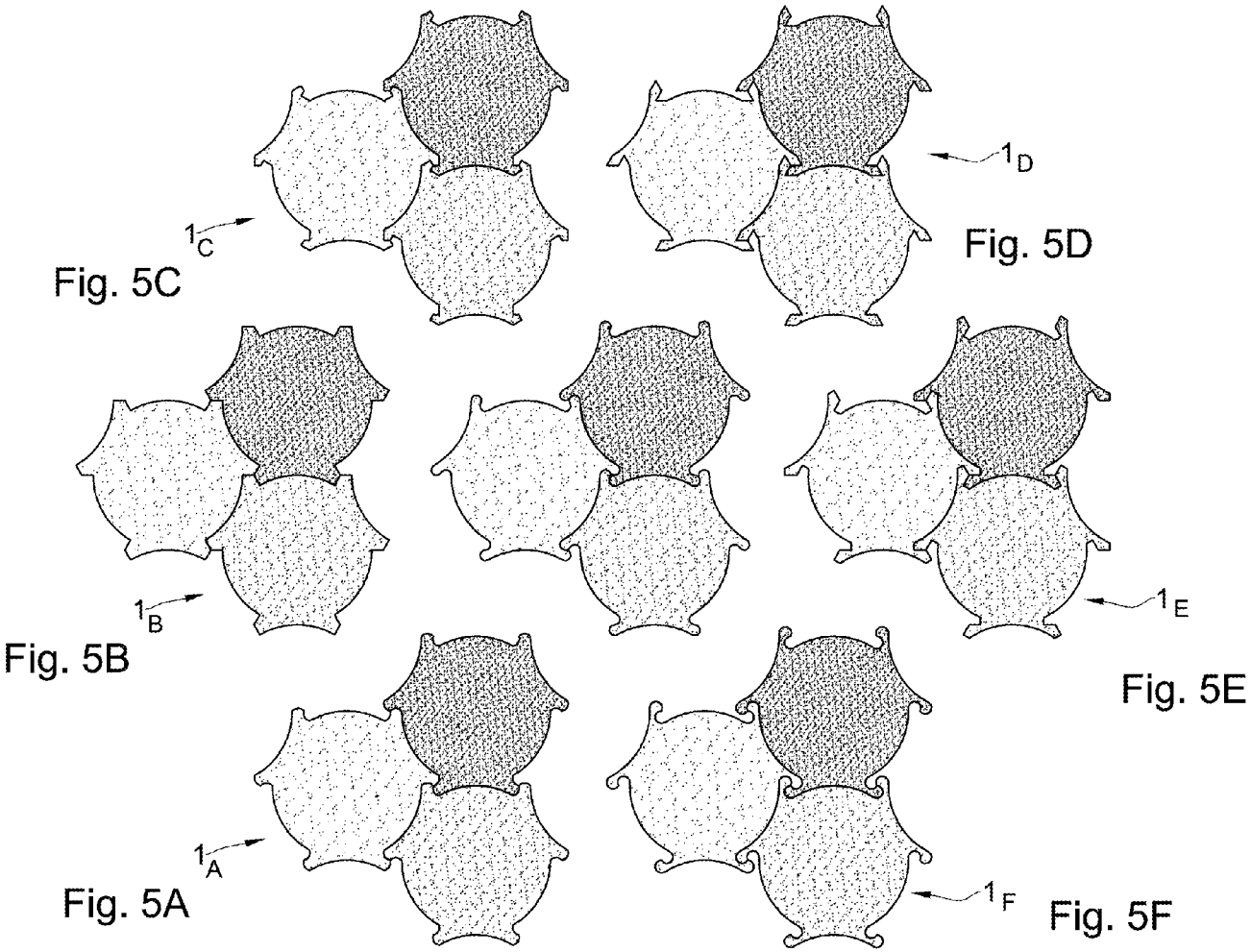
FIGS. 5A to 5F are schematic planar views of several different examples of mosaic designs of the subject matter of the present application.
Figure 6A:
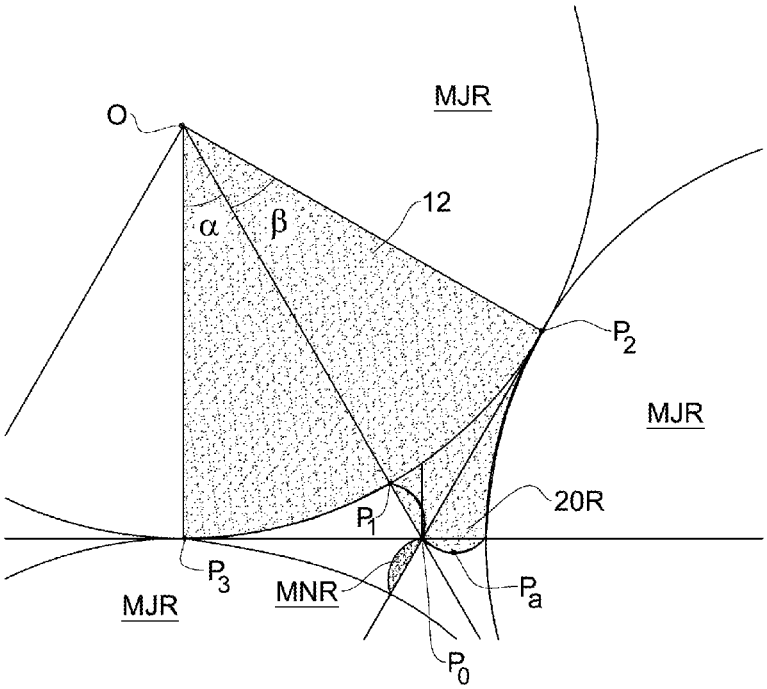
FIGS. 6A to 6F are schematic enlarged views of the construction of each of the different examples shown in FIGS. 5A to 5F respectively.
Figure 6B:
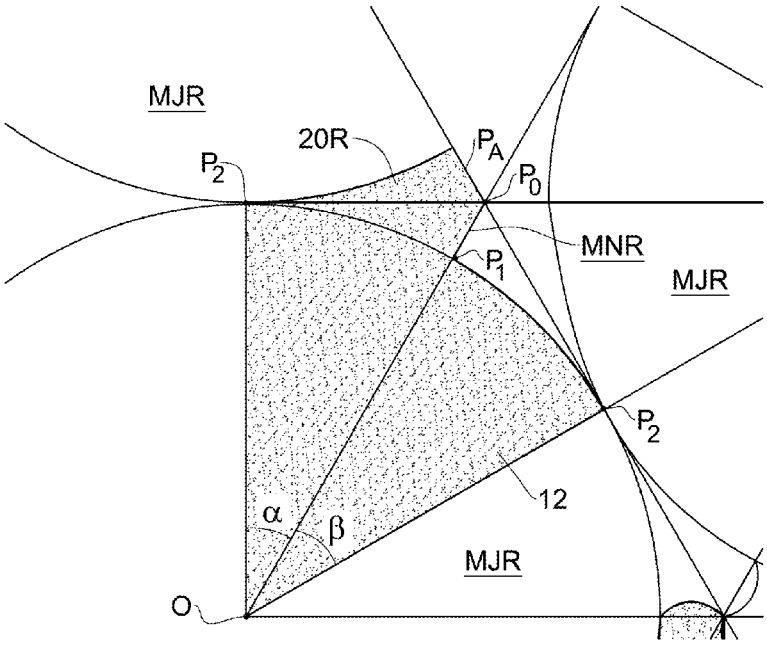
Figure 6C:
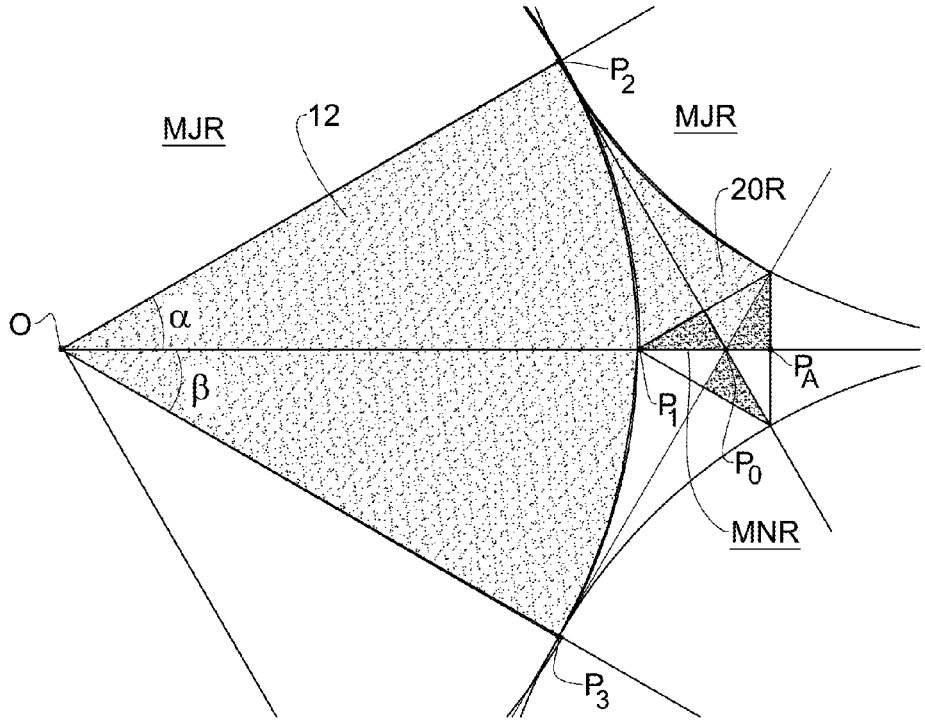
Figure 6D:
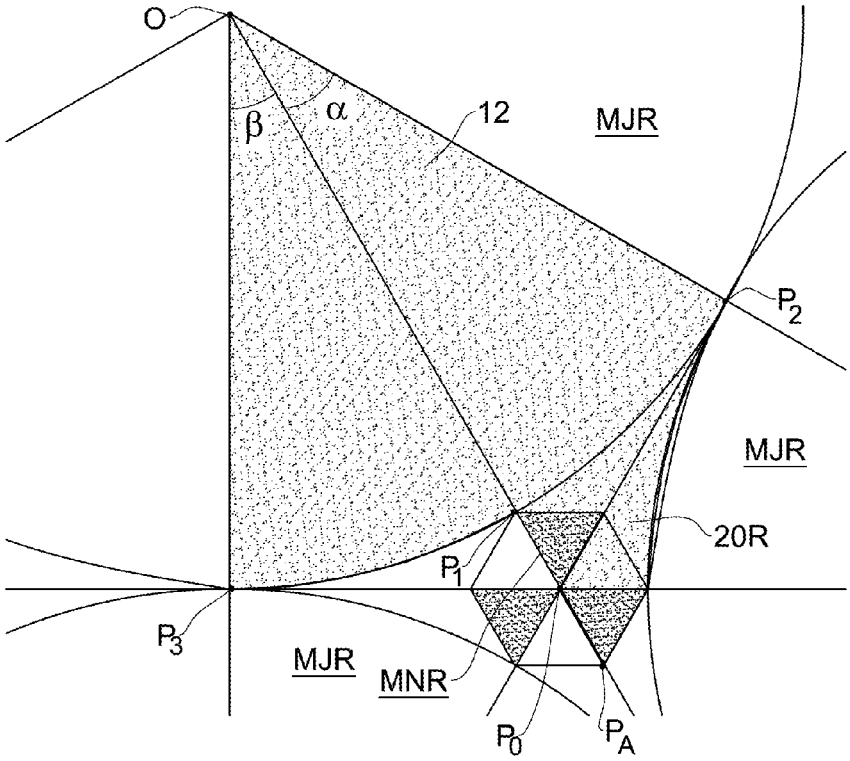
Figure 6E:
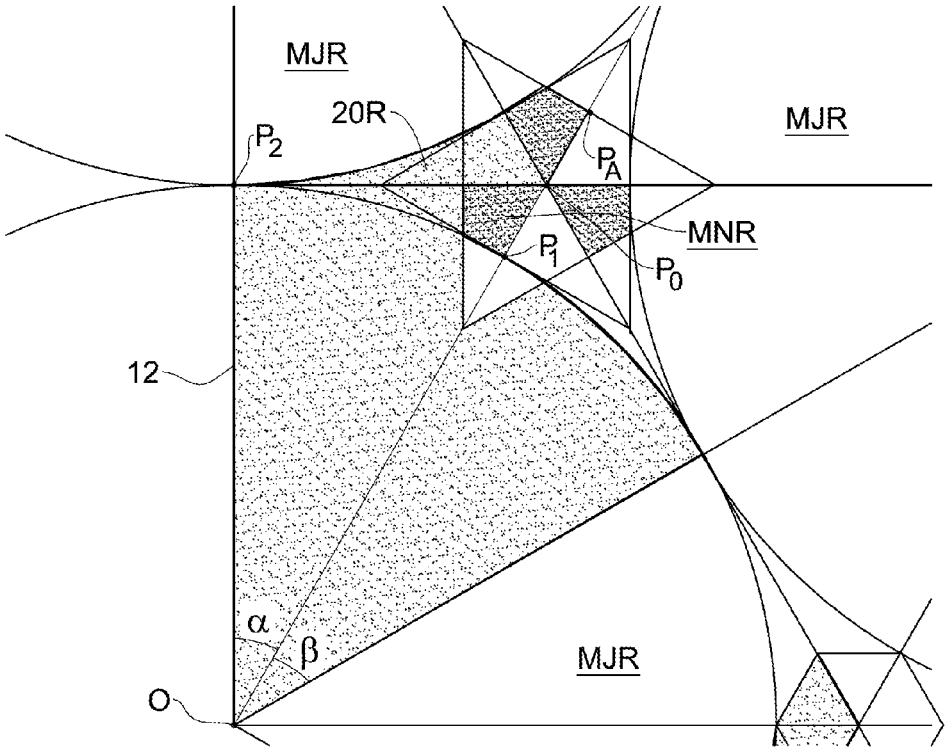
Figure 6F:
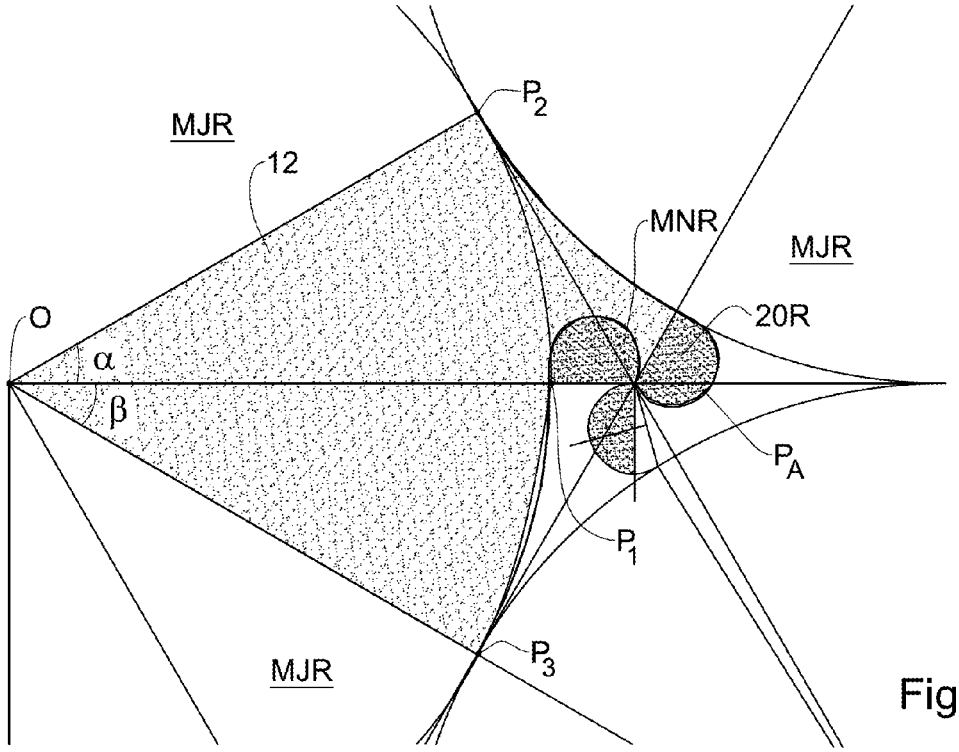

Attention is now being drawn to FIG. 4, in which seven mosaic pieces are shown being articulated to one another. It is observed that the mosaic pieces 10 comfortably cover up the majority of the area defined by the outer contours thereof with the exception of a very small free area defined between the right/left projection portions of three adjacent mosaic pieces.

Reference is now being made to FIGS. 5A to 5F, showing various examples of mosaic pieces designated 1A to 1F respectively. It is observed that in each of these mosaic pieces 1A to 1F, the same locking engagement between two and/or three mosaic pieces is still possible by matching size and shape of the projection portions 20 to the recesses 16, however each such mosaic piece 1A to 1F defers from the others in the exact shape of the recess/projection.

In order to understand what constitutes the difference between the mosaic pieces, attention is now drawn FIGS. 6A to 6F, demonstrating the geometric construction of each of the mosaic pieces 1A to 1F. It is observed that the major shapes MJR used in the construction of all these mosaic pieces are circles, similarly to the mosaic piece 1 previously described. However, the minor shapes MNR used defer from one example to the other. In particular, the minor shapes MNR are as follows:

- mosaic piece 1A—the minor shape is a portion of a circle formed by an arc and a string extending between two points—$P_0$ and $P_1$;
- mosaic piece 1B—the minor shape is simply a line extending between the center of the area defined between the major portion MJR and its respective major portion;
- mosaic piece 1C—the minor shape MNR is a right angled triangle;
- mosaic piece 1D—the minor shape is an equilateral triangle;
- mosaic piece 1E—the minor shape is a kite; and
- mosaic piece 1F—the minor shape is defined by a combination of several arcs.

It is noted that each such minor shape MNR, yields a different shape of the projection unit 20, and more specifically it dictates the shape of both the left and the right projection portions of the projection unit 20.

Figure 7A:
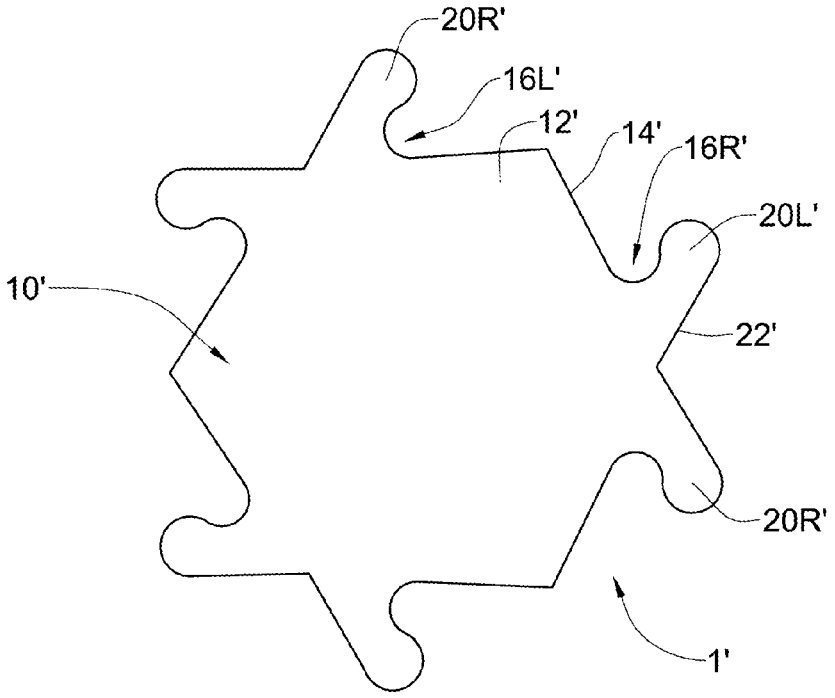
FIGS. 7A and 7B are schematic planar views demonstrating two additional examples of mosaic pieces of the subject matter of the present application.

Turning now to FIG. 7A, another mosaic piece generally designated 1' is shown being constructed by a hexagon serving as the major shape MJR and circles serving as the minor shapes MNR. Under such a design, the contour of the body 10' will not be circular but rather hexagonal. However, this mosaic piece 1' still maintains all the features of the previously described mosaic pieces allowing engagement between two mosaic pieces, the locking therebetween, the snap fitting and the axial movement.

Figure 7B:
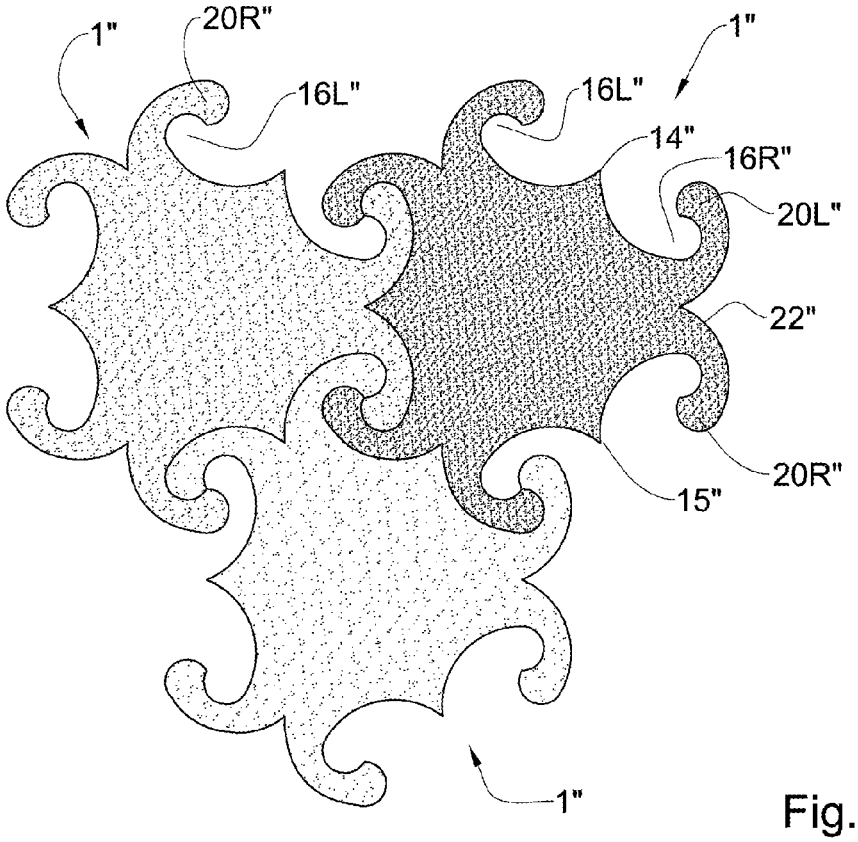

With attention being drawn to FIG. 7B, another mosaic piece generally designated 1" is shown in which both the major shape MJR and the minor shape MNR are unique geometric shapes, in particular the major shape MJR is a hexagonal based shape with the sides of the hexagon being concaved inwards (towards the center thereof), and the minor shape MNR is an amorphic shape.

Figure 8A:
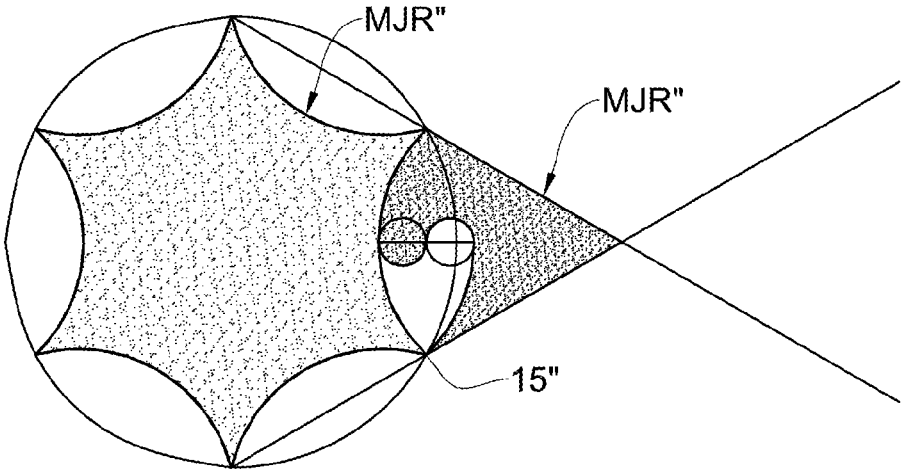
FIGS. 8A and 8B are schematic planar views demonstrating the construction of a mosaic piece similar to that shown in FIG. 7B.
Figure 8B:
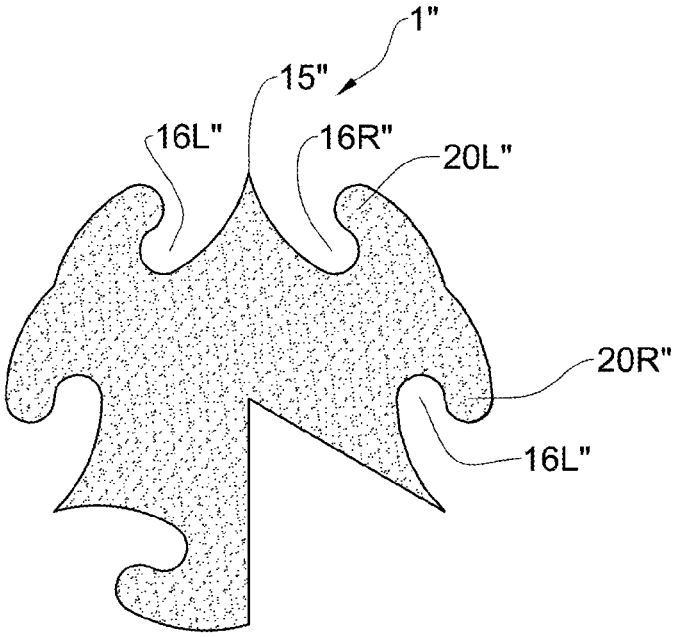

With reference to FIGS. 8A and 8B, yet another example of a mosaic piece is shown also based on a major shape MJR which is a hexagon based shape having the sides thereof concaved inwards towards the center of the hexagon.

Figure 9A:
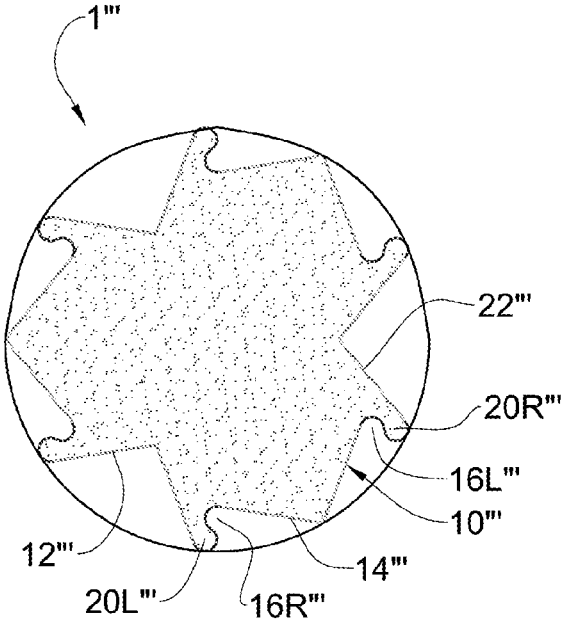
FIG. 9A is a schematic top view of a mosaic piece according to yet another example of the subject matter of the present application.
Figure 9B:
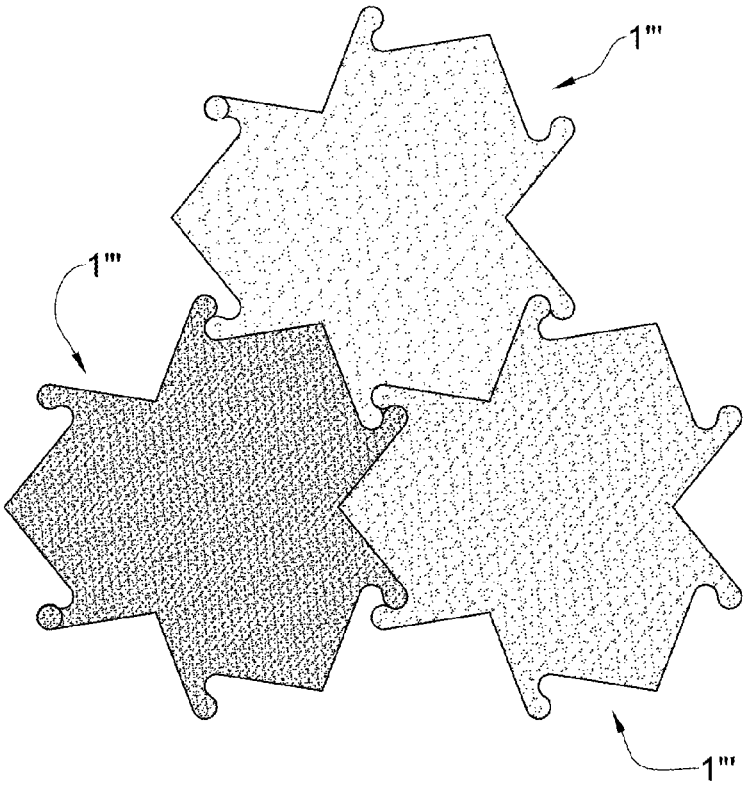
FIG. 9B is a schematic top view showing three of the mosaic pieces shown in FIG. 9A, when engaged with one another.

Turning now to FIGS. 9A and 9B, yet another example of a mosaic piece generally designated as 1'" is shown being based on a unique major shape MJR, and minor shape MNR which is a circle as in the previously described examples. However, it is noted that even this mosaic piece 1'" still maintains the essential functional features of mosaic pieces previously described.

Figure 10A:
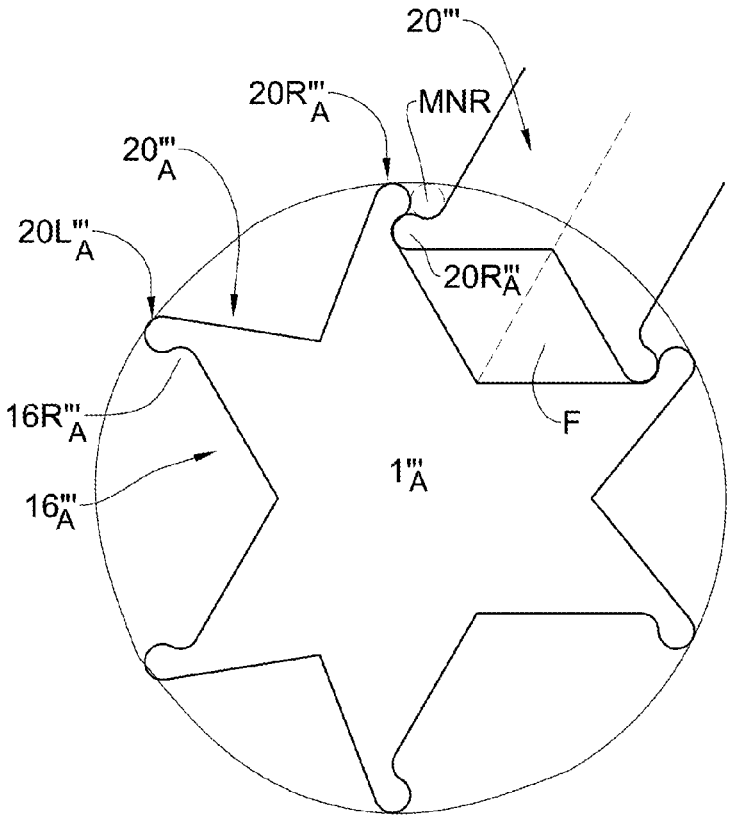
FIGS. 10A to 10C are schematic planar views of yet three more examples of mosaic designs of the subject matter of the present application.
Figure 10B:
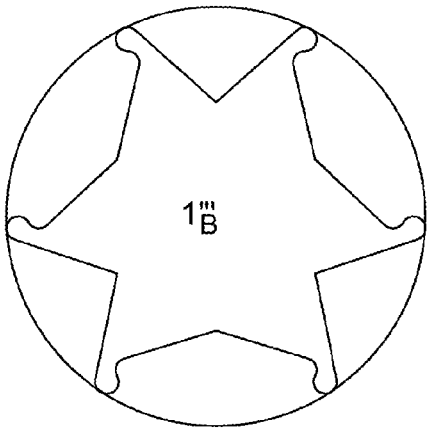
Figure 10C:
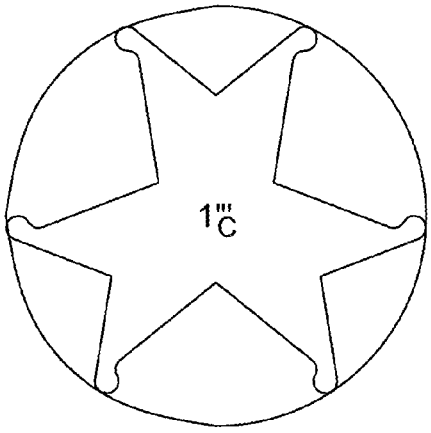

Reference is now being made to FIGS. 10A, 10B and 10C in which three more examples of mosaic pieces are shown generally designated 1'"A, 1'"B and 1'"C respectively. However, deferring from all the previously described examples, in these particular cases the major shape MJR do not possess a hexagonal symmetry, but rather a triangular symmetry. As a result, the projection unit 20A'" does not fully correspond in shape to the recess 16A'". Nonetheless, the projection still corresponds in size to the recess 16'"A such that it may be received therein yet leaving a certain space uncovered designated by the letter F. It should be noted, that even such a design of the mosaic piece still allows firm engagement between two mosaic pieces and the locking feature previously referred to.

With reference to FIGS. 10B and 10C being specifically made, these describe a slightly different mosaic piece than that described in FIG. 10A, the difference being reflected in the angles of the major shape MJR.

Figure 11A:
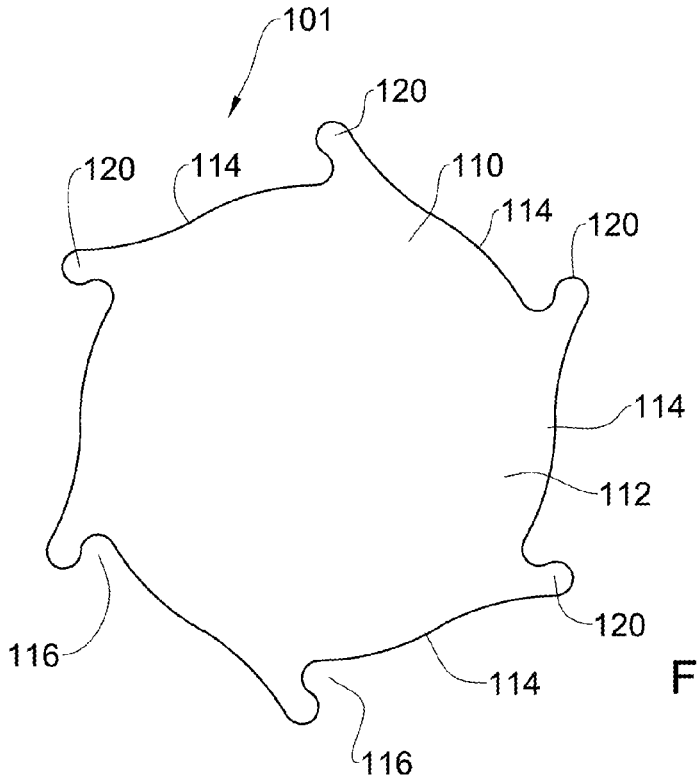
FIGS. 11A to 11C are schematic planar views of three unidirectional examples of mosaic designs of the subject matter of the present application.

Turning now to FIG. 11A, yet another mosaic piece generally designated 101 is shown having a uni-directional hexagonal symmetry and six projection units 120 (as opposed to three in the previous examples) such that the projection units 120 all face in one direction (in the present example in a counterclockwise direction). It is noted, that each such projection unit 120 has a shape identical to that of the left projection portion defined with respect to FIG. 1A. Under such an arrangement, three mosaic pieces may still be articulated to one another to cover a certain area, and the contours thereof will also match in shape and size, however the locking feature may not be provided under this example.

Figure 11B:
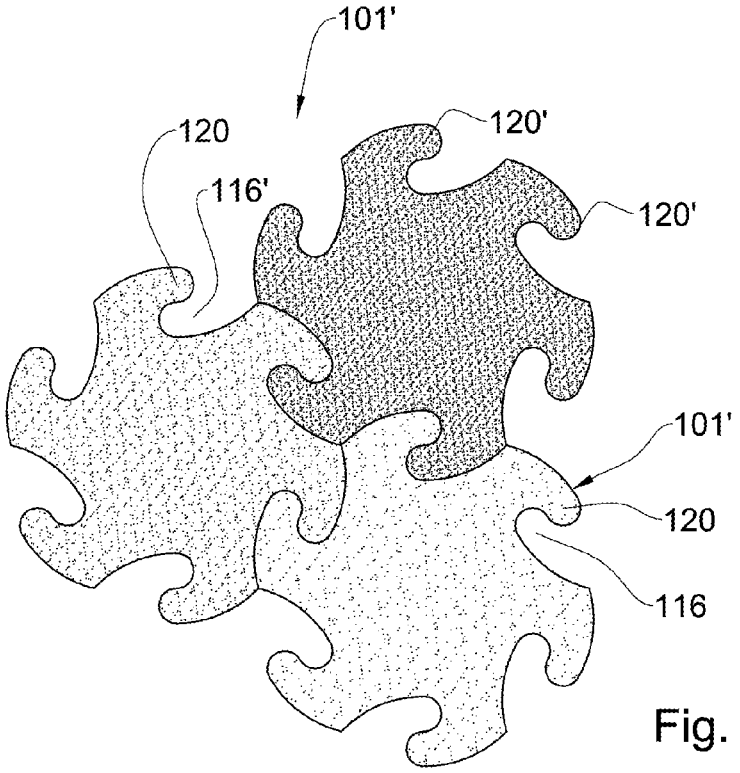

Another example of a mosaic piece being generally designated 101' is shown in FIG. 11B, in which the shape of the projection unit is slightly different, yet the locking features is still provided.

Figure 11C:
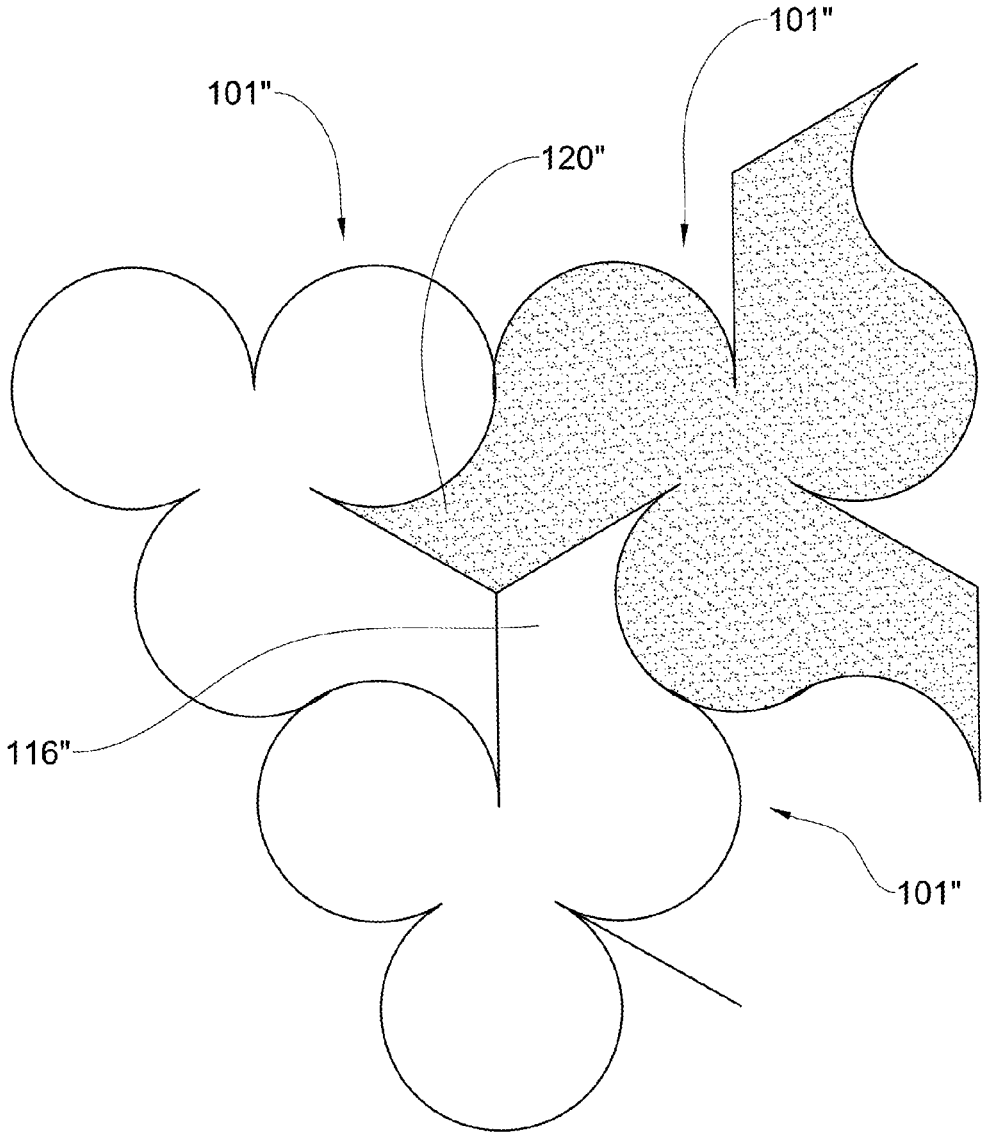

Attention is now being drawn to FIG. 11C, in which yet another example of mosaic pieces 101" is shown in which the major shape MJR used is a shape created by three tangent circles, and the minor shape is an amorphic kite shape. It is observed, that three such mosaic pieces can comfortably cover planar surface leaving no interstitial uncovered areas.

Figure 12:
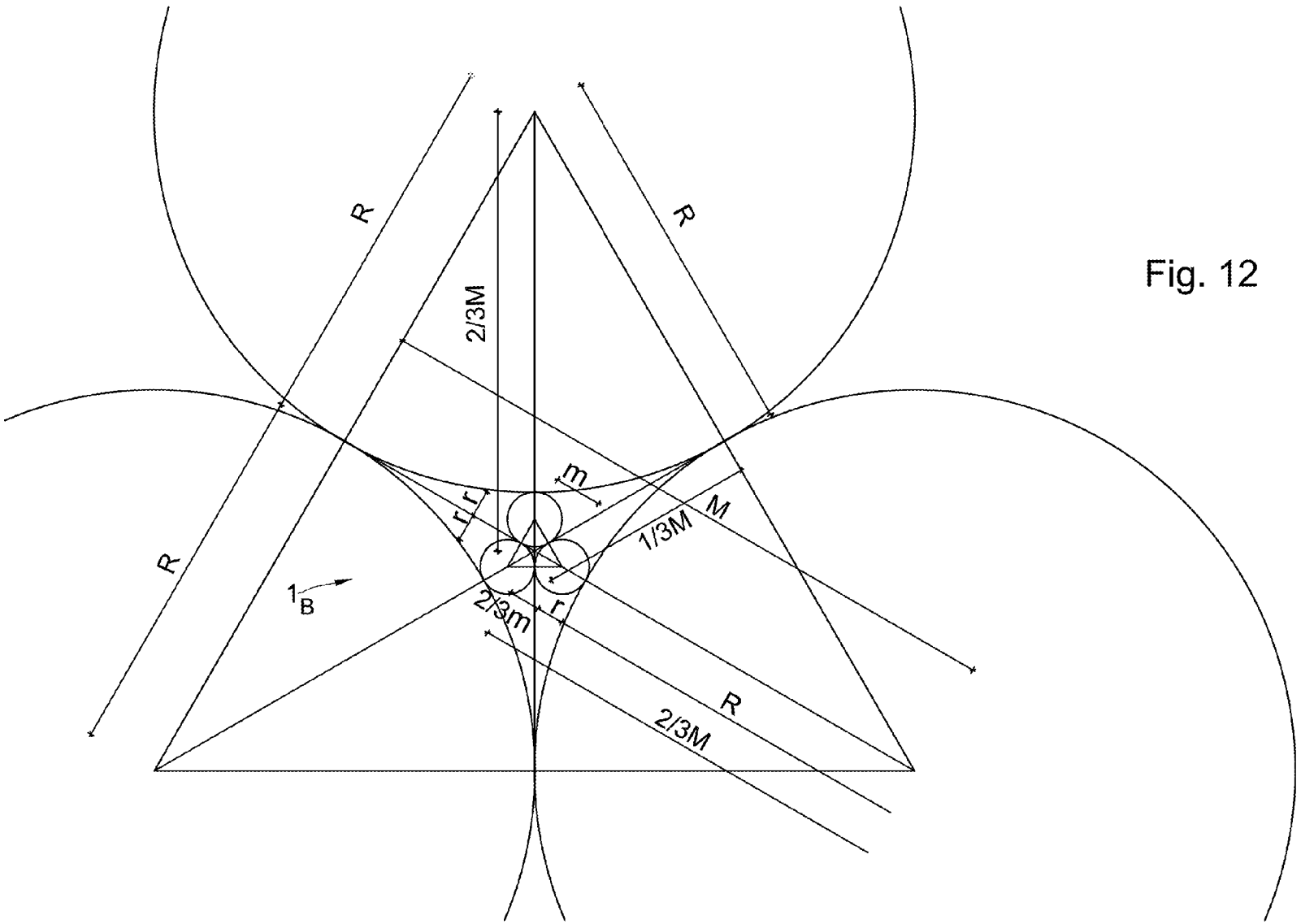
FIG. 12 is a schematic top view demonstrating the size ratios of the mosaic piece during its construction.

Referring now to FIG. 12, various dimensions and ratios of construction of a mosaic piece of FIG. 1A are provided.

Figure 13A:
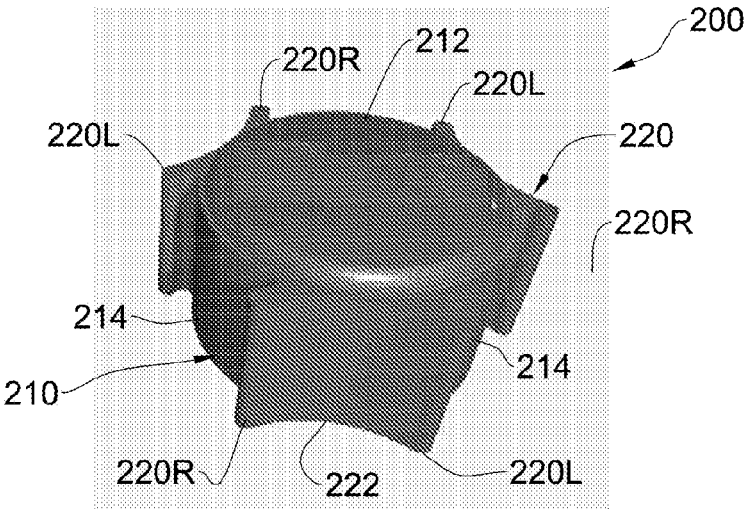
FIGS. 13A and 13B are schematic isometric views of the mosaic piece shown in FIGS. 1A to 1E when used as a bottle cap.
Figure 13B:
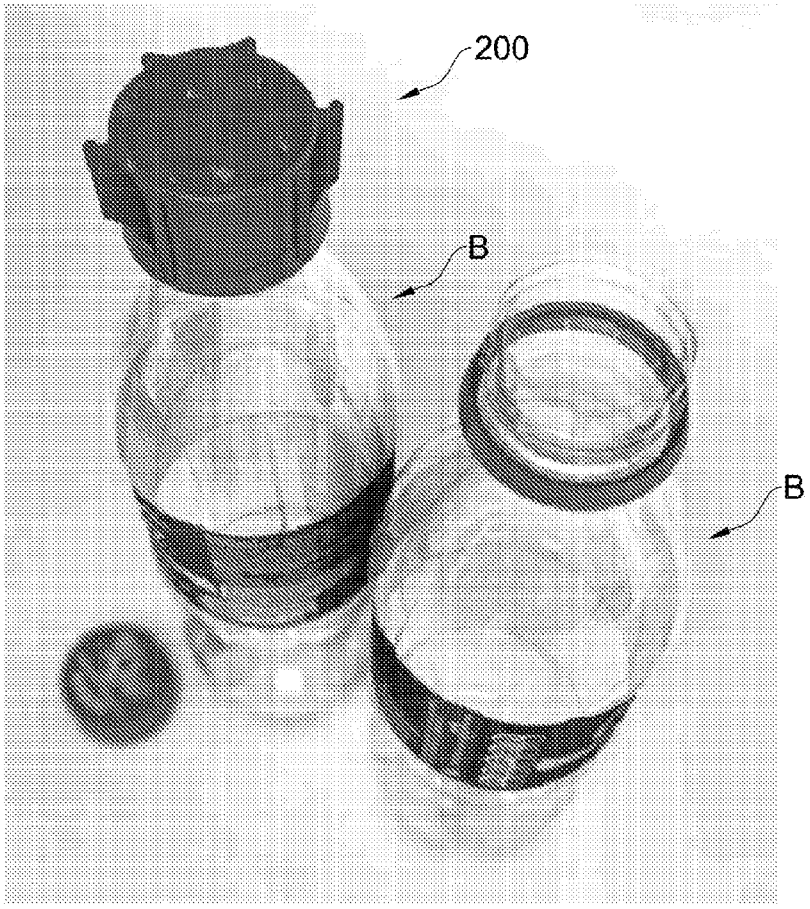
Figure 13C:
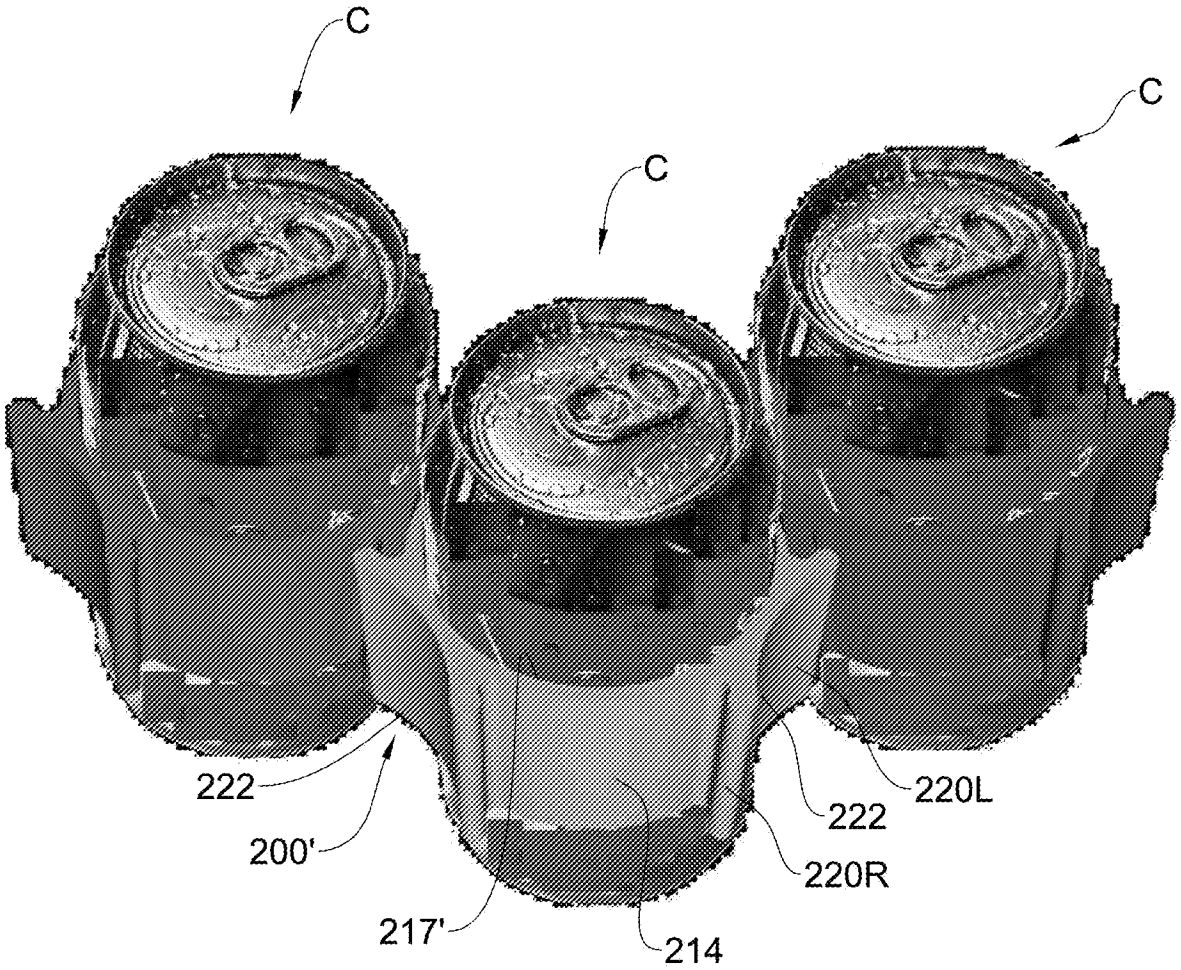
FIG. 13C is a schematic isometric views of the mosaic piece shown in FIGS. 1A to 1E when used as a can holder.

Attention is now being drawn to FIGS. 13A to 13C, in which one example for use of the mosaic pieces is demonstrated. In particular, a bottle cap generally designed 200 has the general shape of the mosaic piece 1 previously described. As in the mosaic piece 1, the bottle cap has a body 210 and projection units 220, each projection unit having a right projection portion 220R and a left projection portion 220L.

In FIG. 13B, the bottle cap 200 is shown capping a bottle B. It is appreciated that such bottle caps, instead of being disposed of once the bottle is no longer needed, may be collected and articulated to other bottle caps to form various shapes, designs, constructions, structures, etc. On top of providing a green solution to plastic disposal (i.e. the caps are not thrown away but are being re-used) such caps may provide an interesting game for children and adults alike or be constructed into useful elements in daily life (e.g. coasters, plates, floors, furniture etc.).

According to a particular business concept, each such cap may be provided with a different color/print/picture/design on the top face thereof, so that collecting different bottle caps and arranging them together may form a bigger picture or print. For example, each such bottle cap may have on the top face thereof a portion of the famous Mona Lisa painting by Leonardo De Vinci, such that collecting enough bottle caps of the right print, may eventually allow constructing the painting on the Mona Lisa.

Such a business concept may allow the manufacturers of the bottle caps/beverages to increase their sales as people will tend to buy beverages/bottles of that company whose caps have a portion of the Mona Lisa print. In particular, such clients/customers will tend to look for those bottle caps which are still required for forming the overall picture/painting.

In addition, due to the unique design of the bottle cap, and in particular the side walls 22 of the projection units, it may be much more convenient to open the bottle having such a cap 200 in comparison with a completely round cap. In particular, the projection units 20 may provide a comfortable gripping area for a person's finger.

Furthermore, for such a bottle cap (and in fact any other bottle cap having a design similar to the designs of the mosaic pieces previously described) may allow using an opener having a recess matching the shape and size of the bottle cap, so that inserting the bottle cap into the recess and then gripping the bottle and rotating it in the right direction, may allow easy opening/closing of the bottle (screwing and unscrewing of the cap).

Turning now to FIG. 13C, another use of the design of the mosaic pieces is shown, being used as a can holder. In particular, the can holder 200' is formed with a central cavity allowing insertion therein on the cylindrical article, in this example a beverage can. Once the beverage can is inserted into the holder 200', several such cans, each having a holder 200' may be articulated to one another in the manner similar to that previously described.

Once the cans are used and thrown out, the holder 200' may still be used as mosaic pieces for the purpose of play and construction.

Figure 14:
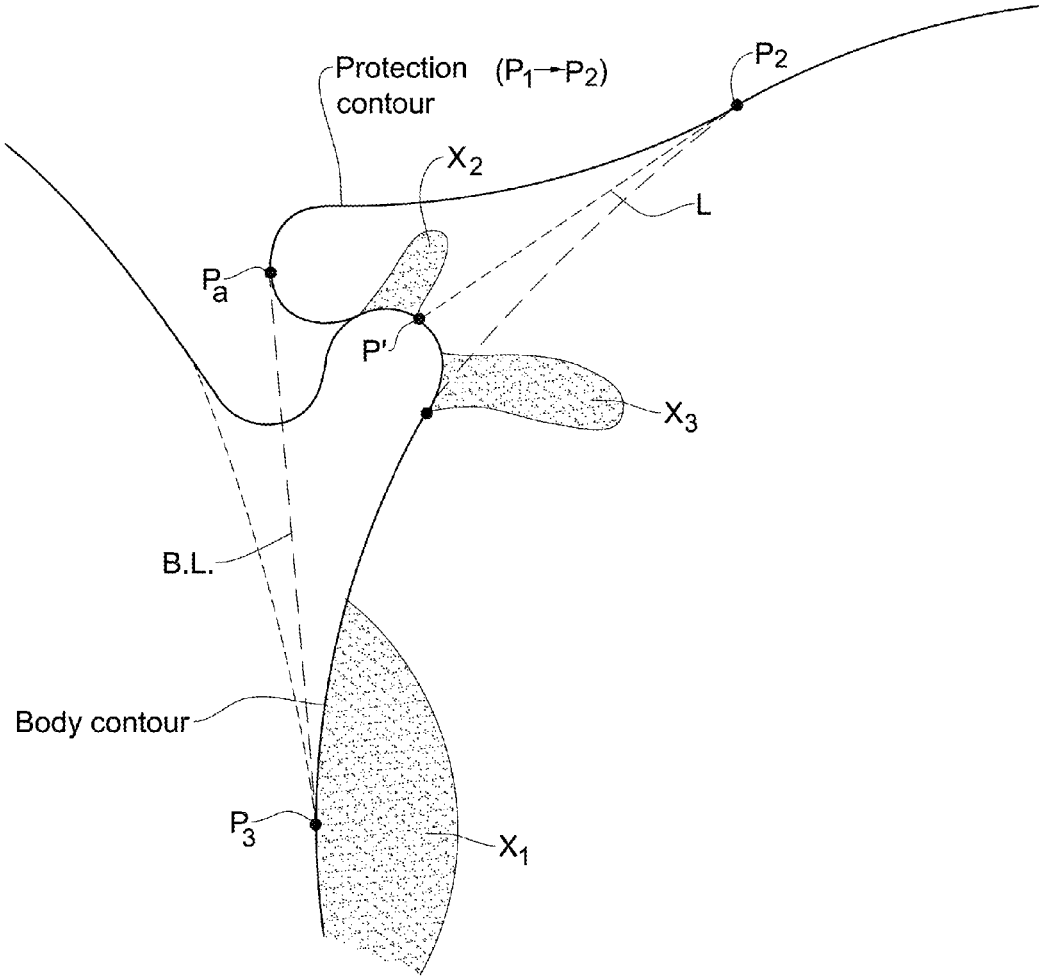
FIG. 14 is a schematic enlarged view of detail A shown in FIG. 1B, with further developments of the design of the mosaic piece.

Turning now to FIG. 14, an example of the mosaic piece 1 shown in FIG. 1A is provided with different variations allowing for free spaces designated X1, X2 and X3, which are similar to the free space F shown in FIG. 10A.

The invention claimed is:

1. A mosaic piece having a body contour inscribable within a circle, and being formed with at least one projection having a projection contour, so that:

said body contour and said projection contour coincide at points $P_1$ and $P_2$;

said circle further contains a point $P_3$ located along said circle outside said projection contour so that the angular distance of $P_3$ from $P_1$ is equal to the angular distance of $P_2$ from $P_1$ with respect to the center of said circle;

said projection contour further contains a point Pa so that an entire said projection contour is located on one side of a reference border line B.L. extended between point $P_3$ and a point Pa;

said mosaic piece being formed with a locking recess having a locking recess contour defined between points $P_3$-$P_1$-Pa, at least a portion of said locking recess contour between $P_3$ and $P_1$ extending along said circle;

said projection contour further comprising a point P' between points Pa and $P_1$;

said projection is formed with an engagement portion having an engagement contour defined between points P'-Pa-$P_2$ and a line L extending between points P' and $P_2$;

wherein said engagement portion is of corresponding shape and size to be fully contained within said locking recess.

2. The mosaic piece according to claim 1, wherein the mosaic piece is configured for attachment to other mosaic pieces, so that at least a portion of the projection of the mosaic piece is configured to be received within a locking recess of a second identical mosaic piece.

3. The mosaic piece according to claim 1, wherein when a projection of the mosaic piece is received within a locking recess of a second, identical mosaic piece, the body engagement contour of the mosaic piece and the projection engagement contour of the second mosaic piece form together a contour at least partially corresponding to the contour defined between points $P_1$ and $P_2$ of the mosaic piece.

4. The mosaic piece according to claim 3, wherein a third mosaic piece is configured to fit within a remaining space defined by the contour between two neighboring mosaic pieces.

5. The mosaic piece according to claim 1, wherein said mosaic piece is formed with a projection unit consisting of two symmetric projections which are mirror images of one another with respect to a line extending between point $P_2$ and the center of the circle.

6. The mosaic piece according to claim 5, wherein the point $P_2$ is a mutual point for the projection contours of the two symmetric projections.

7. The mosaic piece according to claim 5, wherein said mosaic piece comprises at least two projection units.

8. The mosaic piece according to claim 7, wherein said projection units are arranged symmetrically along the mosaic piece with respect a line extending between point $P_3$ and the center of the circle.

9. The mosaic piece according to claim 8, wherein:

said projection unit has a unit contour defined between the respective points $P_1$ of two projections of the projection unit and containing therein point $P_2$; and said mosaic piece has a body portion contour defined between the respective points Pa of two neighboring projection units and containing therein point $P_3$.

10. The mosaic piece according to claim 9, wherein said body portion contour corresponds in shape and size to said unit contour.

11. The mosaic piece according to claim 1, wherein at least said projection is made of flexible material allowing to change the distance between points Pa of adjacent protection units thereby providing snap fitting between two identical mosaic pieces.

12. The mosaic piece according to claim 11, wherein the friction between two identical mosaic pieces, when attached to one another, is sufficient for preventing movement thereof with respect to one another along a central axis of the circle.

13. The mosaic piece according to claim 1, wherein the ratio between the diameter of the circle d and the diameter D of a circle inscribing the entire mosaic piece including the at least one projection is d/D is about 0.9.

14. The mosaic piece according to claim 1, wherein said mosaic piece is formed with an inner cavity having a thread and shaped and sized to be used as a bottle cap.

15. The mosaic piece according to claim 14, wherein said cavity is configured for accommodating therein a portion of a bottle.

16. A mosaic piece according to claim 1, the 2D shape of which is obtainable by the following steps:

providing three identical major shapes, each shape being symmetric about at least three axes, equally spaced at 120° and coinciding at O;

arranging said three identical major shapes such that each two neighboring major shapes having a contact point at $P_2$;

providing one median line for each two neighboring major shapes passing through the respective point $P_2$ and point O of the other of said three major shapes, intersecting its contour at a point $P_1$, three such medium lines intersecting each other at a point $P_0$ located at an area A delimited between the three identical major shapes and not occupied thereby; and providing three identical minor shapes within area A which are equally spaced at 120° about point $P_0$, and arranging said three identical minor shapes so that each minor shape has at least a contact point with one of said three identical major shapes at its respective point $P_1$, and another point P located in area A;

wherein for each major shape, a projection can be defined having a contour extending through points $P_2$, $P_1$ of the neighboring major shape, P and $P_1$ of the same major shape.

17. The mosaic piece according to claim 16, wherein said minor shapes have a point of coincidence at $P_0$.

18. The mosaic piece according to claim 16, wherein said minor shapes do not intersect each other.

19. The mosaic piece according to claim 16, wherein said 2D shape constitutes the base for a 3D construction of a mosaic piece.

20. A bottle cap having a body contour inscribable within a circle, and being formed with at least one projection having a projection contour, so that:

said body contour and said projection contour coincide at points $P_1$ and $P_2$;

said circle further contains a point $P_3$ located along said circle outside said projection contour so that an angular distance of $P_3$ from $P_1$ is equal to an angular distance of $P_2$ from $P_1$ with respect to a center of the circle;

said projection contour further contains a point Pa so that an entire said projection contour is located on one side of a reference border line B.L. extended between point $P_3$ and a point Pa;

said mosaic piece being formed with a locking recess having a locking recess contour defined between points $P_3$-$P_1$-Pa, at least a portion of said locking recess contour between $P_3$ and $P_1$ extending along said circle;

said projection contour further comprising a point P' between points Pa and $P_1$;

said projection is formed with an engagement portion having an engagement contour defined between points P'-Pa-$P_2$ and a line L extending between points P' and $P_2$;

wherein said engagement portion is of corresponding shape and size to be fully contained within said locking recess.

* * * * *